US008651194B2

(12) United States Patent
Yoshida

(10) Patent No.: US 8,651,194 B2
(45) **Date of Patent: *Feb. 18, 2014**

(54) FIRE EXTINGUISHING GAS SPRAY DEVICE

(76) Inventor: Hideo Yoshida, Tokorozawa (JP)

( * ) Notice: Subject to any disclaimer, the term of this patent is extended or adjusted under 35 U.S.C. 154(b) by 381 days.

This patent is subject to a terminal disclaimer.

(21) Appl. No.: 12/225,826

(22) PCT Filed: Apr. 18, 2007

(86) PCT No.: PCT/JP2007/058403

§ 371 (c)(1),
(2), (4) Date: Sep. 29, 2008

(87) PCT Pub. No.: WO2007/135825

PCT Pub. Date: Nov. 29, 2007

(65) Prior Publication Data

US 2009/0173506 A1 Jul. 9, 2009

(30) Foreign Application Priority Data

May 18, 2006 (JP) ..... 2006-138589
Apr. 11, 2007 (JP) ..... 2007-103491

(51) Int. Cl.
*G08B 21/00* (2006.01)

(52) U.S. Cl.
USPC ..... 169/72; 169/30; 169/51; 169/56; 169/60; 169/76; 169/89; 222/23; 222/83; 239/71; 239/72; 239/309

(58) Field of Classification Search
USPC ..... 169/51, 30, 71, 72, 76, 81, 83, 88, 89, 169/56, 60; 222/5, 80, 83, 23, 39; 137/68.29, 68.3; 239/71, 72, 309; 116/3, 4, 202
See application file for complete search history.

(56) References Cited

U.S. PATENT DOCUMENTS 1,015,987 A * 1/1912 Bjur et al. ..... 169/88
2,506,983 A * 5/1950 Williams ..... 116/106
2,764,121 A * 9/1956 Showstack ..... 116/106
2,778,434 A * 1/1957 Hastert et al. ..... 169/89
2,778,435 A 1/1957 Downham et al.

(Continued)

FOREIGN PATENT DOCUMENTS

EP 0 112 950 7/1984
JP 52-164397 12/1977

(Continued)

*Primary Examiner* — Steven J Ganey
(74) *Attorney, Agent, or Firm* — Jordan and Hamburg LLP

(57) ABSTRACT

A jetting apparatus for fire extinguishing gas has a gas cylinder which is charged with pressurized fire extinguishing gas therein and onto an opening of which a sealing plate opening is attached. The jetting apparatus has a two part case that can receive the gas cylinder. The jetting apparatus has a seal breaking member that has a neb capable of breaking the sealing plate. The jetting apparatus has a seal breaking member holder that is attached the seal breaking member. The jetting apparatus has a mouth part of the gas cylinder that is attached detachably, and a cylinder holder that has a through hole movably housing the seal breaking member therein. The jetting apparatus has a seal breaking member holder and a cylinder holder that can relatively approach each other. The jetting apparatus has a jetting port that is provided on the outside of the apparatus and can communicate with the through hole. The jetting apparatus has a control valve that can intercept passages communicating the through hole with the jetting port and is provided in the passages.

15 Claims, 17 Drawing Sheets

(56) References Cited

U.S. PATENT DOCUMENTS

| | | | | | |
|---|---|---|---|---|---|
| 3,172,478 | A | * | 3/1965 | Giclas | 169/89 |
| 3,228,474 | A | * | 1/1966 | Huthsing, Jr. | 169/85 |
| 3,441,087 | A | * | 4/1969 | Poitras | 169/85 |
| 3,540,408 | A | * | 11/1970 | Messick | 116/4 |
| 3,589,446 | A | * | 6/1971 | Bower | 169/89 |
| 3,785,334 | A | * | 1/1974 | Waldeck | 116/106 |
| 3,998,274 | A | * | 12/1976 | Liautaud | 169/89 |
| 4,072,933 | A | * | 2/1978 | Pun | 340/521 |
| 4,121,533 | A | * | 10/1978 | Pappas et al. | 116/5 |
| 4,170,189 | A | * | 10/1979 | Pappas et al. | 116/106 |
| 4,360,802 | A | * | 11/1982 | Pinto | 340/568.8 |
| 4,418,336 | A | * | 11/1983 | Taylor | 340/571 |
| 4,862,968 | A | * | 9/1989 | Woodman | 169/75 |
| 5,544,647 | A | * | 8/1996 | Jewett et al. | 128/200.23 |
| 5,562,163 | A | * | 10/1996 | Sartain et al. | 169/51 |
| 5,704,428 | A | * | 1/1998 | Asano | 169/74 |
| 5,952,919 | A | * | 9/1999 | Merrill | 340/539.18 |
| 6,138,768 | A | * | 10/2000 | Fujiki | 169/30 |
| 6,641,286 | B2 | * | 11/2003 | Hincher, Sr. | 362/253 |
| 2001/0026221 | A1 | * | 10/2001 | Toyota | 340/573.1 |

FOREIGN PATENT DOCUMENTS

| | | |
|---|---|---|
| JP | 57-163258 | 10/1982 |
| JP | 7-313615 | 12/1995 |
| JP | 9-103512 | 4/1997 |
| JP | 10-85352 | 4/1998 |
| JP | 2890097 | 2/1999 |
| JP | 2000-189534 | 7/2000 |
| JP | 2004-351047 | 12/2004 |

* cited by examiner

FIRE EXTINGUISHING GAS SPRAY DEVICE

BACKGROUND OF THE INVENTION

The present invention relates to a jetting apparatus for fire extinguishing gas. This invention is suitable for a handy fire extinguisher, for example, in a house, an office or a vehicle, easily punctures a small gas cylinder charged therein, temporarily prevents gushed fire extinguishing gas from outflowing and being wasted by a valve, and attempts to use the fire extinguishing gas effectively and extinguish a fire effectively. Further, this invention jets the fire extinguishing gas to a fire source surely and properly in fire fighting so that this invention can realize that a fire is extinguished effectively, surely and early; and informs sufferers where a fire extinguisher is when a fire occurs so that a sufferer can use the fire extinguisher quickly and extinguish a fire early.

For example, popular fire extinguishers, which are set in houses or offices, mostly have difficulty in use because the fire extinguishers are large and heavy, require force to handle.

Therefore, many kinds of small, light, handy, fire extinguishers have been invented to solve the difficulty. Methods of piercing a sealing plate on a gas cylinder classify the handy fire extinguishers into three kinds of fire extinguishers, that is, fire extinguishers that a tubular body or a cover is turned, fire extinguishers that an operation block is pushed down, and fire extinguishers that a head or a bottom is knocked.

The fire extinguishers that a tubular body or a cover is turned has a tubular body that receives a gas cylinder, an upper cover body that is screwed into an upper end of the tubular body, a cylinder fitting body that can be screwed into a threaded mouth of the gas cylinder, and a nozzle body that attaches a piercing pipe thereto. Regarding the described fire extinguishers, a center tubular part of the cylinder fitting body is inserted into an opening of an upper part of the tubular body; the nozzle body is inserted inside of the center tubular part; an upper part of the nozzle body is inserted into an opening of the upper cover body; in fire fighting, the upper cover body or the tubular body is turned in axial rotation, the piercing pipe is moved toward the gas cylinder, and cooling gas gushes from a jetting hole of the nozzle body (see the patent document 1).

The fire extinguishers that an operation block is pushed down has an operation face and a tab of a safety block on an upper part of a case capable of receiving a gas cylinder; a shaft body with a piercing pipe that is attached in the case to slide upward and downward; and a retainer that is put on a retaining slot for the shaft body. Regarding the described fire extinguishers, in fire fighting, the safety block is pulled down through the tab, the operation face is pushed to move the retainer inside, rims of the retaining slot and an opening are disengaged, the shaft body is pushed down by resilience of a spring, the piercing pipe is moved toward the gas cylinder to pierce a sealing plate, gushed gas is moved into the shaft body, and then the gushed gas is jetted from a jetting hole (see the patent document 2).

The fire extinguishers that a head or a bottom is knocked has a gas cylinder that is received in a pipe body covered with a cover; a dish-form nozzle that is attached on a lower end of the pipe body; a pusher guiding body that is attached on an upper end of the pipe body; and a pusher with a piercing pipe that is attached in the pusher guiding body to slide. Regarding the fire extinguishers, a safety plate is normally inserted into the pusher to prevent the pusher from moving; on the other hand, a cylinder receiver is attached in the pusher guiding body and is screwed a threaded mouth of the gas cylinder. Further, in fire fighting, the safety plate attached in the pusher is pulled out of the pusher, the out side of the pusher is knocked by a hand to be pushed in, the piercing pipe is moved toward the gas cylinder to pierce a sealing plate, gashed gas moves from the inside of the pipe body to the inside of the shaft body, and then the gushed gas is jetted from a jetting hole (see the patent document 3).

However, there are problems in the fire extinguishers classified into three kinds of fire extinguishers.

With respect to the fire extinguishers that a tubular body or a cover is turned, there is a problem that the tubular body or the cover should be turned so many times that the piercing pipe can pierce a sealing plate because the piercing pipe is slightly moved in spite of turning the tubular body or the cover many times. Therefore, it takes time to pierce the sealing plate and it is difficult to extinguish a fire quickly.

With respect to the fire extinguishers that an operation block is pushed down, there is a problem in that operation for fire fighting is complicated because the operation requires to push down a safety block and push an operation face.

Moreover, with respect to the fire extinguishers that a head or a bottom is knocked, operation for fire fighting is comparatively easy and the fire extinguishers can extinguish a fire quickly, however, there is a problem in that a safety plate is pulled out prankishly or accidentally to pierce a sealing plate because the safety plate is shown outside.

In addition, all of three kinds of fire extinguishers, the jetting hole is faced to a fire source when a sealing plate is pierced, however, as a user concentrates on piercing the sealing plate in fire fighting, and has difficulty in facing the jetting hole to a fire source property, as a result, early jetted gas is wasted, or cannot be used efficiently. Therefore, as a fire cannot be extinguished early and may be substantially extinguished by gas not wasted, there is a problem in that a fire cannot be extinguished successfully considering to the amount of charged gas and the gas cannot be used efficiently.

Then, when a fire extinguisher is used in a fire breaking, a user is too hurry and upset to know or remember where a fire extinguisher is, and the fire may not be extinguished early.

The mentioned troubles are particularly seen when the fire is extinguished at night or in power failure.

In order to solving the troubles, there are fire extinguishers that has a power supply part, a switch and an alarm transmitting part, and an alarm is raised when the switch is turned on (see the patent document 4).

However, the fire extinguishers may not help sufferers to find the fire extinguishers because the switch is provided on a safety plug and sufferers can find the fire extinguishers when the safety plug is pulled out and the switch is turned on to inform the sufferers of the presence of the fire extinguishers. Further, in case no sufferers know where the fire extinguishers are, the sufferers cannot use the fire extinguishers, and there is a problem in that the fire extinguishers cannot be used quickly because the alarm is raised by a sufferer, and it takes time to raise an alarm.

Patent document 1: Japanese unexamined patent publication No. H09-103512

Patent document 2: Japanese unexamined patent publication No. 2000-189534

Patent document 3: Japanese Patent publication No. 2890097

Patent document 4: Japanese unexamined patent publication No. 2004-351047

SUMMARY OF THE INVENTION

It is an object of the present invention to solve the mentioned problem and to provide a jetting apparatus for fire extinguishing gas that is suitable for a handy fire extinguisher, for example, in a house, an office or a vehicle, easily pierces a sealing plate of a small gas cylinder charged therein, temporarily prevents gushed fire extinguishing gas from outflowing and being wasted by a valve, and attempts to use the fire extinguishing gas effectively and extinguish a fire effectively. Further, this invention jets the fire extinguishing gas to a fire source surely and properly in fire fighting so that this invention can realize that a fire is extinguished effectively, surely and early; and informs sufferers where the fire extinguisher is so that a sufferer can use the fire extinguisher quickly and extinguish a fire early when a fire occurs.

This invention has a gas cylinder that is charged with pressurized fire extinguishing gas and attaches a sealing plate on an opening thereof; cases (a top case and a bottom case) that can receive the gas cylinder; a piercing member that has a point capable of piercing the sealing plate; a piercing member holder that attaches the piercing member therein; and a mouth part of the gas cylinder that is provided detachably. Moreover, this invention has a cylinder holder that has a through hole that movably houses the piercing member therein; the piercing member holder or the cylinder holder that can approach the cylinder holder or the piercing member holder; a jetting port provided outside of the jetting apparatus for fire extinguishing gas and the through hole that can communicate each other. Regarding the jetting apparatus for fire extinguishing gas as described above, a control valve that can intercept a passage communicating the through hole with the jetting port is provided in the passage. Thus, this invention prevents fire extinguishing gas, which is gushed after piercing the sealing plate, from being released and being wasted, can accurately jet the fire extinguishing gas to a fire source, and attempts to use the fire extinguishing gas effectively and extinguish a fire early and effectively.

According to the present invention, the control valve can usually close so that the control valve can prevent the fire extinguishing gas, which gushes after the sealing plate is pierced, from being released and being wasted. According to the present invention, the control valve can open on demand, this invention can accurately jet the fire extinguishing gas, which gushes after the sealing plate is pierced, to a fire source, and can realize that the fire extinguishing gas is used efficiently and a fire is extinguished early and effectively.

According to the present invention, the passage is formed in the piercing member holder, and the control valve is disposed in a middle part of the passage so that the control valve can open or close to surely control release or interception of the fire extinguishing gas that moves in the passage.

According to the present invention, a housing is disposed in the top case, a control lever is turnably connected over an upper part of the housing, and the control lever is disposed on a surface of the top case. Moreover, the piercing member holder is fixed in the housing, a pushrod that can engage with the control valve is provided in an upper part of the piercing member holder to move vertically, the control lever is disposed to engage with the pushrod, and the control valve can surely open or close through the concrete structure for control.

According to the present invention, the piercing member holder is disposed in an upper part of the housing and the cylinder holder is disposed in a lower part of the housing, the cylinder holder can approach and be apart from the piercing member holder. Thus, the present invention can realize that the cylinder holder moves upward and the piercing member pierces the sealing plate when the sealing plate is pierced; and the fire extinguishing gas is stored after piercing the sealing plate.

According to the present invention, a tubular piercing member is disposed at a lower end part of a passage formed in the piercing member holder. The through hole can store the fire extinguishing gas gushed from the gas cylinder after the sealing plate is pierced, and the fire extinguishing gas that is stored in the through hole can be jetted from the jetting port when the control valve opens.

According to the present invention, after the sealing plate is pierced, the cylinder holder is provided to move upward, and the piercing member can be apart from the sealing plate. Thus, the present invention helps the fire extinguishing gas to gush from the gas cylinder, attempts to increase the capacity of the through hole, and can increase the quantity of stored fire extinguishing gas.

According to the present invention, a lamp is disposed on the outside of the top case, and can be turned on when the sealing plate is pierced. Therefore, a sufferer can easily and surely extinguish a fire in power failure or at night.

According to the present invention, a bottom case is slidably attached at a lower part of the top case, and the bottom case can receive the bottom of the gas cylinder. When the bottom case is operated to move upward, the bottom case or the cylinder holder moves upward to turn on the lamp, therefore, the lamp can be turned on concretely.

According to the present invention, a sufferer can extinguish a fire easily and surely, and can use the lamp as emergency light after the fire is extinguished because the lamp can keep lighting after the sealing plate is pierced as described.

According to the present invention, an installation holder that has a pair of clutch arms facing each other is provided to be install on a wall, and the clutch arms detachably attach a lower end part of the top case therebetween. Then, a jetting apparatus for fire extinguishing gas is installed in place, thus, the gas cylinder is prevented from moving upward when the jetting apparatus for fire extinguishing gas is not used, and the gas cylinder is previously prevented from being accidentally pierced.

When the jetting apparatus for fire extinguishing gas is used, the jetting apparatus for fire extinguishing gas is pulled out of the clutching arms, and the gas cylinder is helped to move upward and be pierced. Thus, the jetting apparatus for fire extinguishing gas do not require complicated operation that the jetting apparatus for fire extinguishing gas is detached and the safety ring is pulled out. Therefore, this invention attempts to operate the apparatus easily and quickly and extinguish a fire early.

According to the present invention, an alarm apparatus is provided on a surface of or in the jetting apparatus for fire extinguishing gas. The alarm apparatus can work an alarm or/and an alarm lamp through a signal, which is sent from an accident alarm, for the occurrence of a fire or an earthquake that is sent from an accident alarm, and then notifies of the presence of the jetting apparatus for fire extinguishing gas. Therefore, the jetting apparatus for fire extinguishing gas can be used quickly and a fire can be extinguished early.

According to the present invention, the alarm apparatus is removably attached on a surface of the jetting apparatus for fire extinguishing gas. Therefore, the alarm apparatus attempts to be used when the alarm apparatus is attached on and detached from the jetting apparatus for fire extinguishing gas.

According to the present invention, the alarm apparatus is detached from the jetting apparatus for fire extinguishing gas, and a sufferer can wear the alarm apparatus. Thus, the sufferer can notify of his/her existence, and this invention attempts to be useful to rescue and know safety of the sufferer.

According to the present invention, there are two jetting apparatuses for fire extinguishing gas in the jetting apparatus for fire extinguishing gas. That is, one can be operated with one hand and is portable, and the other is large, heavy, operated with both hands and installed in place. Therefore, the present invention can broadly apply to jetting apparatuses of fire extinguishing gas regardless of size.

According to the present invention, a container is provided in the jetting apparatus for fire extinguishing gas. The container can store fire extinguishing powder, a fire extinguishing liquid chemical, a fire extinguishing chemical or fire extinguishing water; and the fire extinguishing gas can be brought in the container. The fire extinguishing powder, the fire extinguishing liquid chemical, the fire extinguishing chemical or the fire extinguishing water can be jetted from the jetting port, and is jetted by the fire extinguishing gas. Thus, this invention can be used in extinguishing various kinds of fires.

According to the present invention, a control valve that can intercept a passage communicating a through hole with a jetting port is provided in the passage. Thus, this invention prevents fire extinguishing gas, which is gushed after a sealing plate is pierced, from being released and being wasted, can accurately jet the fire extinguishing gas to a fire source, and attempts to use the fire extinguishing gas effectively and extinguish a fire early and effectively.

According to the present invention, the control valve can usually close so that the control valve can prevent the fire extinguishing gas, which gushes after the sealing plate is pierced, from being released and being wasted.

According to the present invention, the control valve can open on demand. Thus, this invention can accurately jet the fire extinguishing gas, which gushes after the sealing plate is pierced, to a fire source, and can realize that the fire extinguishing gas is used efficiently and the fire is extinguished early and effectively.

According to the present invention, the passage is formed in a piercing member holder and the control valve is disposed in a middle part of the passage so that the control valve opens or closes to surely control release or interception of the fire extinguishing gas that moves in the passage.

According to the present invention, a housing is disposed in a top case, and a control lever is turnably connected to an upper part of the housing, and the control lever is disposed on a surface of the top case. Moreover, the piercing member holder is fixed in the housing, a pushrod that can engage with the control valve is provided in an upper part of the piercing member holder to move vertically, the control lever is disposed to engage with the pushrod, and the control valve can surely open or close through the concrete structure for control.

According to the present invention, the piercing member holder is disposed in an upper part of the housing, a cylinder holder is disposed in a lower part of the housing, and the cylinder holder can approach and be apart from the piercing member holder. Thus, the present invention can realize that the cylinder holder moves upward and the piercing member pierces a sealing plate when the sealing plate is broken; and the fire extinguishing gas is stored after the sealing plate is pierced.

According to the present invention, a tubular piercing member is disposed at a lower end part of the passage formed in the piercing member holder. The through hole can store the fire extinguishing gas gushed from the gas cylinder after the sealing plate is pierced, and the fire extinguishing gas that is stored in the through hole can be jetted form the jetting port when the control valve opens.

According to the present invention, the cylinder holder is provided so that the cylinder holder can move upward after the sealing plate is pierced, and the piercing member can be apart from the sealing plate. Thus, the present invention helps the fire extinguishing gas to gush from the gas cylinder, attempts to increase the capacity of the through hole, and can increase the quantity of the stored fire extinguishing gas.

According to the present invention, a lamp is disposed on the outside of the top case, and can be turned on when the sealing plate is pierced. Therefore, a sufferer can easily and surely extinguish a fire in power failure or at night.

According to the present invention, a bottom case is slidably attached at a lower part of the top case, and the bottom case can receive the bottom of the gas cylinder. When the bottom case is operated to move upward, the bottom case or the cylinder holder moves upward to turn on the lamp, therefore, the lamp can be turned on concretely.

According to the present invention, a sufferer can extinguish a fire easily and surely, attempts to use the lamp as emergency light after the fire is extinguished and safely evacuate because the lamp can keep lighting after piercing the sealing plate as described.

According to the present invention, an installation holder that has a pair of clutching arms facing each other is provided to be install on a wall, and the clutching arms can clutch a lower end part of the top case. Then, a jetting apparatus for fire extinguishing gas can be installed in place, thus, the gas cylinder is prevented from moving upward when the jetting apparatus for fire extinguishing gas is not used, and the gas cylinder can be previously prevented from being accidentally broken.

When the jetting apparatus for fire extinguishing gas is used, the jetting apparatus is pulled out of the clutching arms, and the gas cylinder is helped to move upward and be broken. Thus, the jetting apparatus for fire extinguishing gas do not require complicated operation that the jetting apparatus for fire extinguishing gas is detached and the safety ring is pulled out. Therefore, this invention attempts to operate the apparatus easily and quickly and extinguish a fire early.

According to the present invention, an alarm apparatus is provided on the surface of or in the jetting apparatus for fire extinguishing gas. The alarm apparatus can work an alarm or/and an alarm lamp through a signal, which is sent from an accident alarm, for the occurrence of a fire or an earthquake, and then notifies of the presence of the jetting apparatus for fire extinguishing gas. Therefore, the jetting apparatus for fire extinguishing gas can be used quickly and a fire can be extinguished early.

According to the present invention, the alarm apparatus is removably attached on a surface of the jetting apparatus for fire extinguishing gas. Therefore, the alarm apparatus attempts to be used when the alarm apparatus is attached on and detached from the jetting apparatus for fire extinguishing gas.

According to the present invention, the alarm apparatus can be detached from the surface of the jetting apparatus for fire extinguishing gas, and a sufferer can wear the alarm apparatus. Thus, the sufferer can notify of his/her existence, and this invention attempts to be useful to rescue and know safety of the sufferer.

According to the present invention, there are two jetting apparatuses for fire extinguishing gas in the jetting apparatus for fire extinguishing gas. That is, one can be operated with one hand and is portable, and the other is large, heavy, operated with both hands and installed in place. Therefore, the present invention can broadly apply to jetting apparatuses of fire extinguishing gas regardless of size.

According to the present invention, a container is provided in the jetting apparatus of fire extinguishing gas. The container can store fire extinguishing powder, a fire extinguishing liquid chemical, a fire extinguishing chemical or fire extinguishing water; and the fire extinguishing gas can be brought in the container. The fire extinguishing powder, the fire extinguishing liquid chemical, the fire extinguishing chemical or the fire extinguishing water can be jetted from the jetting port, and is jetted by the fire extinguishing gas. Thus, this invention can be used in extinguishing various kinds of fires.

BRIEF DESCRIPTION OF THE DRAWINGS

FIG. 4 shows a state that a sealing plate is not pierced yet.

FIG. 10 shows a state that the sealing plate is not pierced yet.

FIG. 11 shows a state of the second embodiment. The bottom case is pushed to move with a cylinder holder, and then the sealing plate is just pierced.

FIG. 13 shows a state that the control lever of the jetting apparatus of fire extinguishing gas is operated, the control valve opens, and fire extinguishing gas jets after the state described in the description of FIG. 12

FIG. 14 shows a state that an alarm signal from an accident alarm is inputted into an alarm apparatus, which is provided in the second embodiment of the jetting apparatus for fire extinguishing gas.

FIG. 19 shows a state that the installation holder is attached.

DETAILED DESCRIPTION OF THE INVENTION

Figure 1:
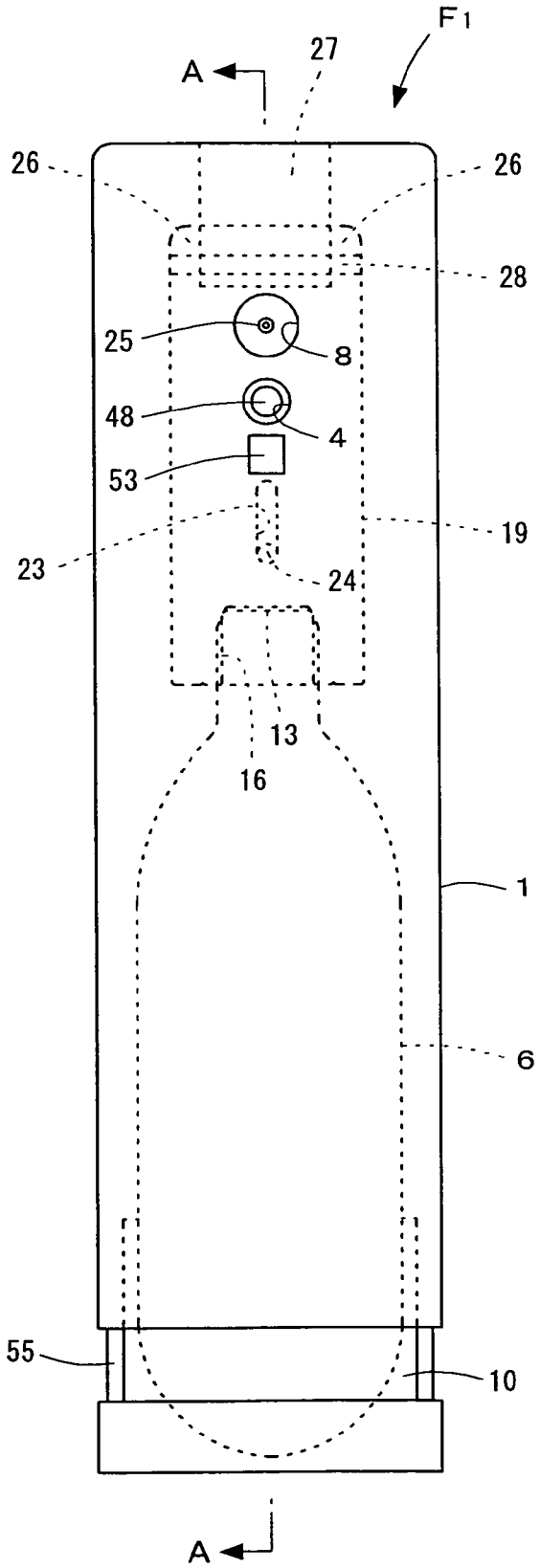
FIG. 1 is a front view of a small, light jetting apparatus for fire extinguishing gas that this invention is applied thereto. The jetting apparatus for fire extinguishing gas is set and is charged with a gas cylinder, which is filled with carbon dioxide as fire extinguishing gas, before the jetting apparatus of fire extinguishing gas is used.
Figure 2:
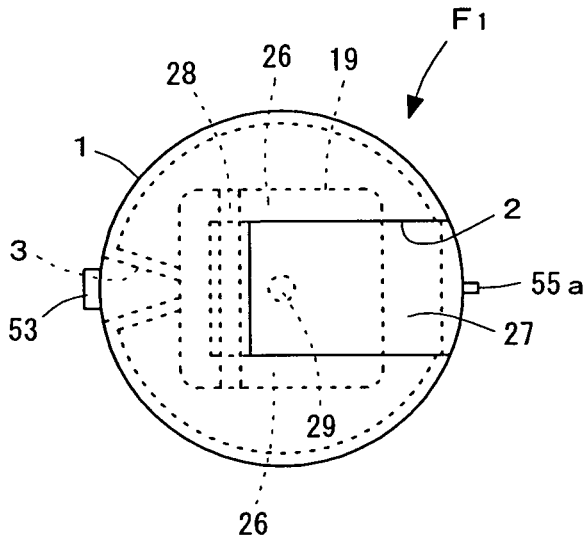
FIG. 2 is a plan view of FIG. 1.

The following is description of illustrated embodiments that this invention is applied to a handy fire extinguisher $F_1$. The handy fire extinguisher $F_1$ is a jetting apparatus for fire extinguishing gas that uses a cartridge gas cylinder, is used in a house or a vehicle, and is small and light to be carried with one hand. Regarding FIGS. 1 to 6, reference numeral 1 denotes a top case that is made of synthetic resin and is hollow and almost tubular. The top case 1 consists of united cut cases that is a pair of halved cases that is axially cut in half along a centerline of a jetting port 3, a lower end of the top case 1 opens, an upper end of the top case 1 closes and is formed to be sloped backward and be approximately taper, and an opening 2 is formed at the center of the upper end of the top case 1.

A control lever, which is described later, is attached in the opening 2, the jetting port 3 is formed on a front upper peripheral surface of the top case 1 to face to a jetting hole, which is described later, and a lamp hole 4 is formed just under the jetting port 3 to be around a lamp, such as an LED.

Regarding the drawings, reference numerals 5, 6 and 7 are engaging pieces that are projected from the upper inside of the top case 1 and are disposed from an upper part to a lower part in the top case 1, the engaging pieces 6 and 7 are formed to be annularly projected from the upper inside of the top case 1, and guide holes 8 and 9 that are the same in shape are respectively formed in the center of the engaging pieces 6 and 7.

A bottom case 10 that is made of synthetic resin, bottomed and tubular is inserted in a lower end part of the top case 1 so that the bottom case 10 slidably contacts with the top case 1. The bottom case 10 is smaller than the top case 1, and the bottom of a known gas cylinder 11 is detachably fitted in the bottom case 10.

Regarding the drawings, reference numeral 12 is a step that is formed at a lower periphery of the bottom case 10, and the step 12 is formed to engage with a lower end part of the top case 1.

The gas cylinder 11 is charged with about 4 MPa of carbon dioxide as fire extinguishing gas, and a sealing plate 13 hermetically seals an upper end opening of the gas cylinder 11, a threaded part 14 is formed on the mouth of the gas cylinder 11, and is screwed to a cylinder holder 15 to be fixed. In the drawings, reference numeral 13*a* is a puncture that is punctured by a piercing member, which is described later.

The cylinder holder 15 is formed to be cylindrical through die casting of aluminum. A screw hole 16 that can screw the threaded part 14 therein is formed at a lower end of the cylinder holder 15, and a guide hole 17 is formed over the screw hole 16 to communicate with the screw hole 16. Reference numeral 18 is an O-ring that is disposed in a part communicating the screw hole 16 with the guide hole 17.

The inside of the guide hole 17 is smooth, and a guide shaft of a piercing member holder, which is described later, is slidably inserted into the guide hole 17.

An outer periphery of the cylinder holder 15 is slidably fitted in a housing 19 that is made of synthetic resin or die-cast aluminum. An outer periphery of the housing 19 is disposed to slidably contact with an inside end of the jetting port 3 and the guide holes 8 and 9.

The housing 19 is formed to be hollow and almost square tube. A slide hole 20 that is smooth is formed in the housing 19, and the piercing member holder 21 that is made of die-cast aluminum is fixed in a given position of an upper part of the slide hole 20 through a fastening 22, such as a pin and a screw.

Two long holes 23 that are vertically long and are formed to be disposed on the front and back peripheries of the housing 19 to face each other. Two fastening pins 24 project from the cylinder holder 15, and each fastening pin 24 is inserted in one of the long holes 23.

Ends of the fastening pins 24 are disposed to engage with engaging pieces 6, 7, therefore, upward or downward movement of the housing 19 is controlled, and the housing 19 can move with the top case 1.

In the drawings, reference numeral 25 is a jetting hole that is formed in an upper front part of the housing 19, and is disposed to face the inside of the jetting port 3.

A pair of brackets 26 projects from an upper end of the housing 19 to face each other. A proximal end of a control lever 27 is disposed between the brackets 26 by a pin 28 to connect with the brackets 26 and turn upward and downward. The other end of the control lever 27 is disposed to engage with an opening edge of the opening 2.

Regarding the drawings, reference numeral 29 is an engaging projection that projects from a lower end of the control lever 27, and is disposed to contact with the a pushrod, which is described later, just over the pushrod. Reference numeral 30 is an opening hole that opens at the center of an upper end part of the housing 19.

The seal breaking member holder 21 is formed to have the same diameter of the cylinder holder 15 and be almost tubular. A penetrating hole 31 that forms a passage for fire extinguishing gas is formed in an upper part of the seal breaking member holder 21, a conducting hole 32 forms the passage for fire extinguishing gas and has a small diameter. An end of the conducting hole 32 is formed to the penetrating hole 31, and the other end of the conducting hole 32 is disposed to face the jetting hole 25.

A valve attachment hole 33 that forms the passage on the same shaft of the penetrating hole 31 is formed in the seal breaking member holder 21, and a screw part is formed at an upper part of the valve attachment hole 33.

The pushrod 35 is inserted in the penetrating hole 31, a flange 36 projects from a middle part of the pushrod 35, and the flange 36 is disposed to engage with a lower end of the opening hole 30.

A spring 37 is inserted between the penetrating hole 31 and the flange 36, the pushrod 35 is biased upward through resilience of the spring 37 so that the pushrod 35 is disposed to engage an upper end of the pushrod 35 with the engaging projection 29 normally.

A control valve 38 is accommodated in the valve attachment hole 33, a screw part 39 of the control valve 38 is screwed up to the screw part 34, and a valve body of the control valve 38 hermetically engages with the valve attachment hole 33.

Regarding the embodiment, the control valve 38 is an air valve of a tire tube for an automobile that is small, inexpensive, and is on sale.

The control valve 38 has a valve rod 40 that penetrates the control valve 38, and an inner valve 41 that can move with the valve rod 40. Further, the valve rod 40 and the inner valve 41 are biased upward by resilience of a valve spring (not shown) so that the inner valve 41 can be pushed to the valve body to open.

On the other hand, the pushrod 35 pushes down the valve rod 40, the inner valve 41 moves to a lower part of the valve body with the movement of the valve rod 40, and the inner valve 41 can open.

Then, the inside of the control valve 38 communicates to the penetrating hole 31 when the inner valve 41 opens, gushed fire extinguishing gas is brought in the control valve 38 after the sealing plate 13 is broken, and the fire extinguishing gas can be sent from the penetrating hole 31 to the conducting hole 32.

A spring 42, which is a volute spring in the embodiment, is inserted between the cylinder holder 15 and the seal breaking member holder 21, resilience of the spring 42 biases the seal breaking member holder 21 upward.

A guide shaft 43 projects downward form a lower end of the seal breaking member holder 21, the valve attachment hole 33 extends in the guide shaft 43.

A lower end of the valve attachment hole 33 is contracted from a middle part of the guide shaft 43 and opens at an end of the guide shaft 43, and a needle tube 45 that is a seal breaking member is disposed in a contracted part 44.

The needle tube 45 is formed from a steel tube that is diagonally cut at an end thereof, and a neb part 45*a* pierces to a thin part of the sealing plate 13 to break the sealing plate 13 easily and smoothly. Therefore, the center of the needle tube 45 is slightly offset to the center of the sealing plate 13.

Regarding the drawing, reference numeral 46 is an O-ring that is attached on the pushrod 35 in the seal breaking member holder 21, and reference numeral 47 is an O-ring that is attached in the neck of an end part of the guide shaft 43.

Further, a lamp 48, such as an LED, is provided in the lamp hole 4, leads 49 of the lamp 48 are connected to a battery 50 that is a power supply, terminals 51, 52 that are in the shape of a leaf spring are disposed to connected each other and insulating film (not shown) is inserted between the terminals 51, 52.

Among the terminals 51 and 52, the terminal 51 that is movable is disposed in the top case 1, and one end of the terminal 52 that is fixed is attached on the bottom case 10.

The insulting film normally prevents the terminals 51 and 52 from contacting each other. When the top case 1 moves downward to break the gas cylinder 11, the terminals 51 and 52 pass across the insulting film to contact each other, and the battery 50 keeps supplying electricity with the lamp 48 to turn on the lamp 48.

In the drawings, reference numeral 53 is an alarm apparatus. The alarm apparatus 53 is attached on the front of the top case 1. Further, the alarm apparatus 53 has a receiver (not shown) that can receive a signal from a fire alarm 54, which is an accident alarm; a microphone that can collect alarm sound from the fire alarm 54; band-pass filter or low-pass filter that can take off noise that is not the alarm; an amplifier that can amplify an inputted signal; a comparator that can compare with the standard of the alarm sound from the fire alarm 54 and can perform an operation; a transmitter and a speaker that can sound an alarm sound that is different from the alarm of the fire alarm 54 in tone; and a power supply that is, for example, a battery.

Besides the microphone, a lamp (not shown), such as an LED, can be provided for the alarm apparatus 53. The lamp can be turned on by the power supply working through a signal from the fire alarm 54.

Regarding the drawings, reference numeral 55 is a safety ring that is attached to cover half of a periphery of the bottom case 10, and is approximately half-annular and resilient. A grip part 55*a* projects from one end of the safety ring 55. The safety ring 55 is normally attached on the periphery of the bottom case 10. Therefore, the safety ring 55 can prevent an accident that the bottom case 10 is pushed in by a trick or false operation and the sealing plate 13 of the gas cylinder 11 is broken when the jetting apparatus for fire extinguishing gas $F_1$ is not used.

Further, the alarm apparatus 53 is disposed near the battery 50 and shares a power supply with the lamp 48 in the embodiment. Although an alarm signal is an alarm sound in the embodiment, the alarm signal is an alarm lamp for an alarm sound, or is used with the alarm sound. The alarm lamp can be turned on or blink.

Regarding the described embodiment, the top case 1 and the housing 19 are separated, however, the top case 1 and the housing 19 can be united because the top case 1 and the housing 19 move together. Further, although the control lever 27 is attached on the housing 19 in the described embodiment, the control lever 27 can be attached on the top case 1.

The jetting apparatus for fire extinguishing gas, which is composed as described, consists of the top case 1 and the bottom case 10 that receive the gas cylinder 11, the cylinder holder 15 that is screwed the screw part 14 of the mouth of the gas cylinder 11, the seal breaking member holder 21 that projects the needle tube 45, the housing 19 that accommodates the cylinder holder 15 and the seal breaking member holder 21 therein, the control lever 27, the control valve 38 that is included in the seal breaking member holder 21, and the alarm apparatus 53.

When the jetting apparatus for fire extinguishing gas $F_1$ is produced, the top case 1, the bottom case 10, the housing 19 and the control lever 27 are made of synthetic resin, the cylinder holder 15 and the seal breaking member holder 21 are made of die-cast aluminum, the control valve 38 is commercially available, and commercial electronics are assembled in a given circuit of the alarm apparatus 53 to produce the alarm apparatus 53.

When the described members are assembled, the seal breaking member holder 21 is accommodated in the upside of the housing 19 and the cylinder holder 15 is accommodated in the downside of the housing 19, and the spring 42 is inserted between the seal breaking member holder 21 and the cylinder holder 15.

Next, the guide shaft 43 of the seal breaking member holder 21 is inserted in the guide hole 17, and the fastening pins 24, 24 are respectively struck into the periphery of the cylinder holder 15 from the outside of the long holes 23, 23.

Further, ends of the fastening pins 24, 24 are fitted in the long holes 23, 23, respectively, and the seal breaking member holder 21 and the cylinder holder 15 are included in the housing 19.

When the members are included in, the control valve 38 and the pushrod 35 are included in the seal breaking member holder 21, and the needle tube 45 is attached at the downside of the guide shaft 43 beforehand.

First, when the control valve 38 is included in, the control valve 38 is inserted in the valve attachment hole 33 of the seal breaking member holder 21, and then the screw part 39 of the control valve 38 is screwed in the screw part 34 of the valve attachment hole 33 to be fitted in.

Next, the spring 37 is disposed just over the control valve 38 and under the pushrod 35 to be disposed between the control valve 38 and the pushrod 35, an upper end of the pushrod 35 is inserted in the open hole 30 of the housing 19 and projects from the housing 19.

Further, when the needle tube 45 is attached at the guide shaft 43, the needle tube 45 is pushed in the contracted part 44 of the valve attachment hole 33, the neb part 45*a* of the needle tube 45 projects from the guide shaft 43, and the needle tube 45 is disposed to be offset to the center of the guide shaft 43.

Before or after the seal breaking member holder 21 and the cylinder holder 15 are included in, the control lever 27 is disposed between a pair of the brackets 26 of the housing 19, a pin 28 is inserted in the base of the control lever 27, and the control lever 27 connects with the pin 28 to turn around the pin 28.

On the other hand, the battery 50 is attached on an engaging piece 6 of the halved cut cases of the top case 1, the lamp 48 is inserted in the lamp hole 4.

The alarm apparatus 53 is attached under the lamp hole 4 on the periphery of the top case 1, the leads 49 connect the lamp 48 with the battery 50, and leads (not shown) connect the described battery 50, which is used for the lamp 48 and the alarm apparatus 53, with the alarm apparatus 53.

Next, the terminal 51 is attached in the top case 1, the terminal 52 is attached outside of the bottom case 10, and the terminals 51 and 52 insert the insulting film therebetween and can contact each other to be conducted electrically.

Before or after the members are included in as described, the halved cut cases are disposed outside the housing 19 to face each other, are united by screws or an adhesive to be approximately cylindrical, the control lever 27 is disposed in the opening 2 of an upper end of the cut cases, and the bottom case 10 is put in a lower end of the cut cases.

Further, a safety ring 55 is fitted on the periphery of the bottom case 10 projecting from the lower end of the top case 1, upper and lower ends of the safety ring 55 are disposed to respectively engage with a lower part of the top case 1 and a flange part of the bottom case 10, and then a series of the production finishes.

Regarding the jetting apparatus for fire extinguishing gas $F_1$, which is assembled as described, the bottom case 10 is slightly pushed in the lower end of the top case 1 to be kept before the gas cylinder 11 is charged in the jetting apparatus for fire extinguishing gas $F_1$, and the jetting apparatus for fire extinguishing gas is formed to be cylindrical overall.

Then, the jetting port 3 and the lamp hole 4 are closely placed at the front of an upper part of the top case 1 so that the jetting port 3 is placed over the lamp hole 4. The jetting hole 25 is placed in the jetting port 3, the lamp 48 is attached in the lamp hole 4, and the alarm apparatus 48 is displayed just under the lamp 48.

The cylinder holder 15 is biased downward in the housing 19 by resilience of the spring 42 to be apart from the seal breaking member holder 21, and the fastening pins 24 respectively engage with the lower ends of the long holes 23 and rest in the engaging state.

Further, the valve body of the control valve 38 airtightly engages with the valve attachment hole 33 to be attached, the valve rod 40 is biased upward by a spring (not shown) that is attached in the control valve 38, and the inner valve 41 that moves with the valve rod 40 is pushed on a lower end of the valve body to keep the inner valve 41 closing.

The pushrod 35 that is above the control valve 38 is biased upward by resilience of the spring 37, an upper end part of the pushrod 35 projects to the outside of the housing 19, engages with the engaging projection 29 that is at a lower side of the control lever 27 to push up the control lever 27.

On the other hand, the end part of the fastening pins 24 engages with the engaging piece 7 that projects from the lowest potion among the engaging pieces 5, 6 and 7, and the top case 1 is apart from the bottom case 10.

Therefore, as the terminals 51 and 52 do not keep conducting not to be supplied electricity, the lamp 48 is turned off.

As the fire alarm 54 does not work at normal time when a fire does not occur, the alarm apparatus 53 stops working and does not sound an alarm sound.

Further, when the jetting apparatus for fire extinguishing gas $F_1$ is installed for use, the bottom case 10 is pulled out of the top case 1, the gas cylinder 11 that is not used is inserted from a lower side of the top case 1 into the top case 1, and the threaded part 14 that is on the periphery of a mouth of the gas cylinder 11 is screwed in the screw hole 16 of the cylinder holder 15 to be charged.

Then, the bottom case 10 is inserted in the lower end part of the top case 1, the bottom of the gas cylinder 11 is fitted in the bottom case 10, and the jetting apparatus for fire extinguishing gas $F_1$ is installed at a given place and in standing.

Figure 3:
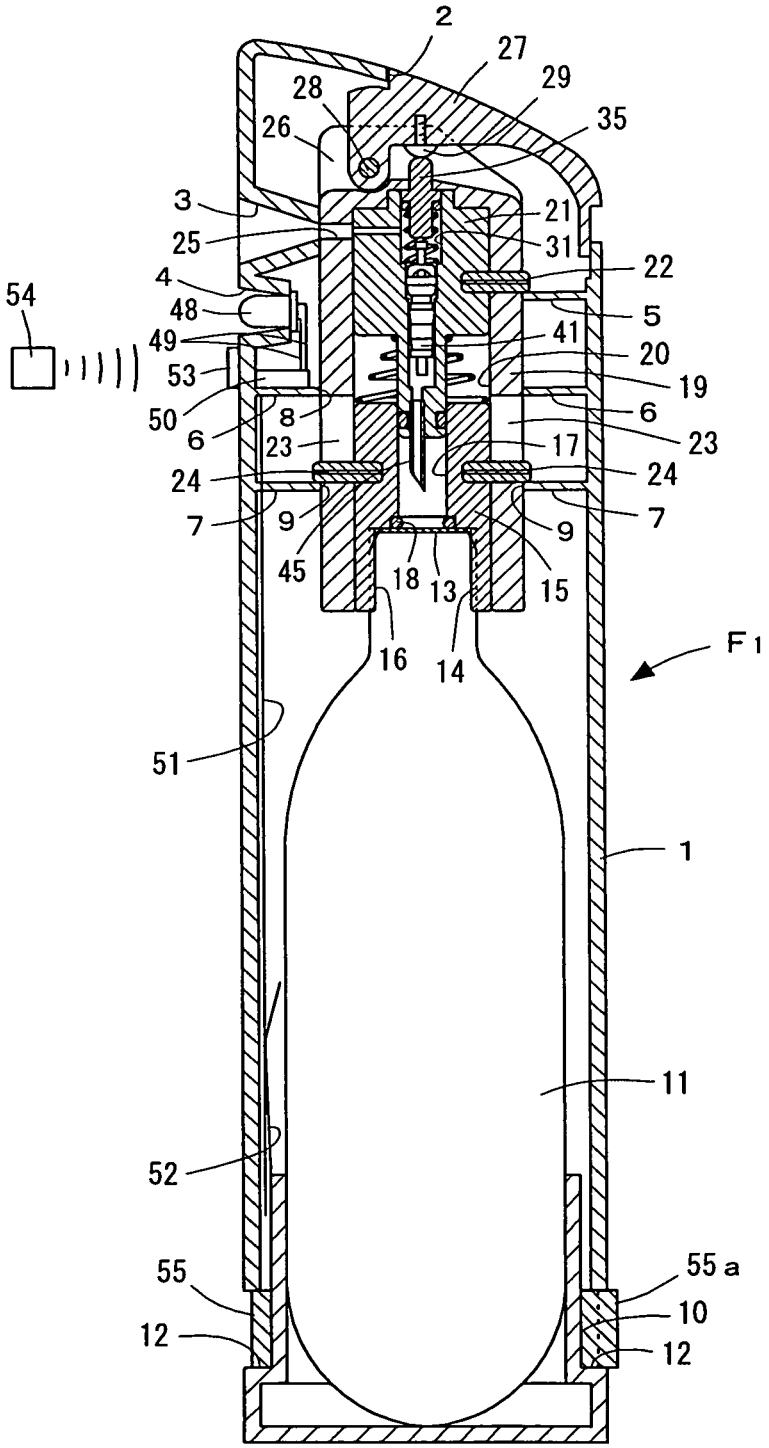
FIG. 3 is a sectional view taken along the line A-A of FIG. 1.
Figure 4:
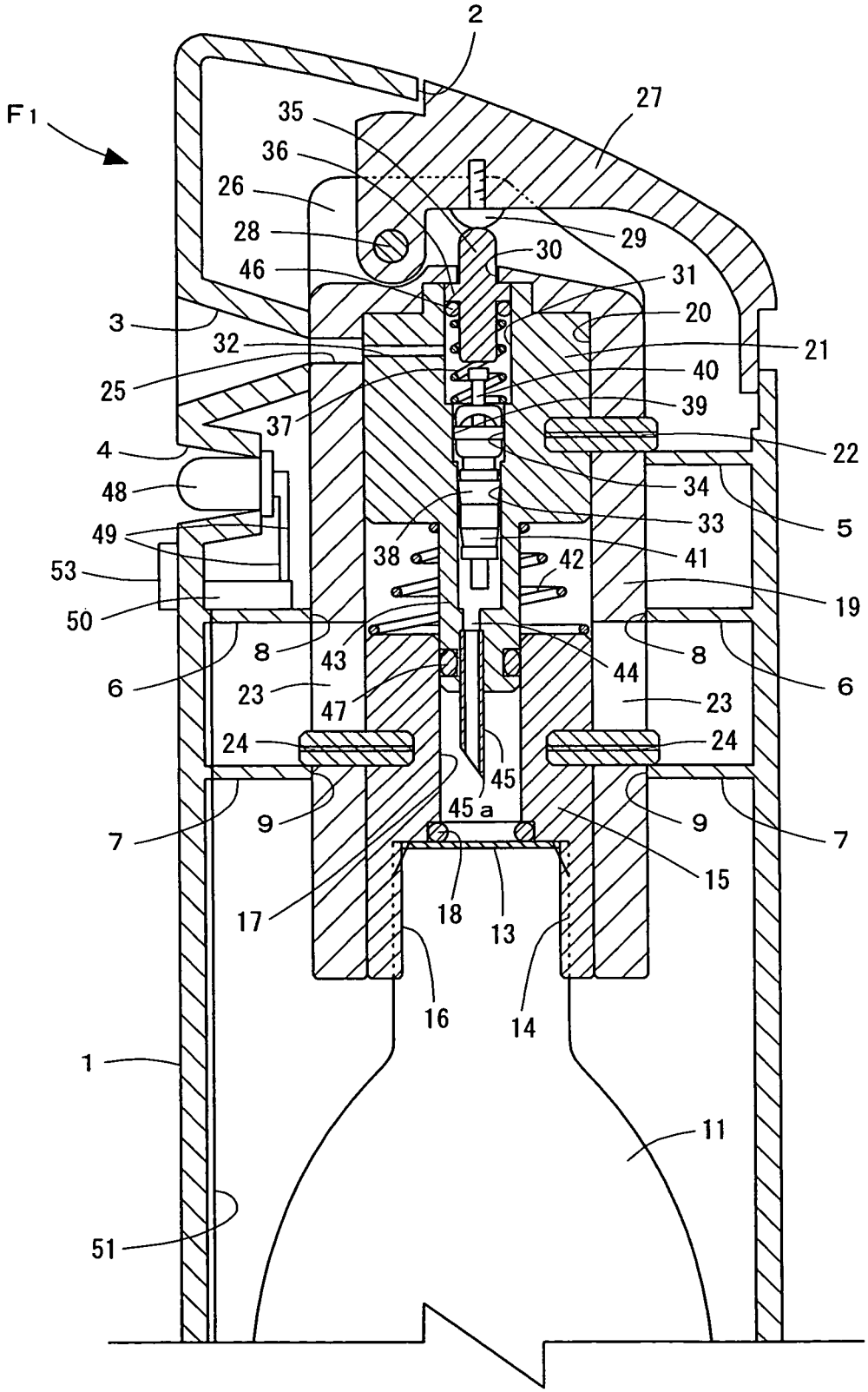
FIG. 4 is an enlarged sectional view showing an important part of FIG. 3.

When the jetting apparatus for fire extinguishing gas $F_1$ is installed as described, a suitable fixer fixes and prevents the jetting apparatus for fire extinguishing gas $F_1$ from falling down. This state is shown in FIGS. 1 and 3.

Regarding the jetting apparatus for fire extinguishing gas $F_1$ that charges the gas cylinder 11, the state is substantially the same with the state of the jetting apparatus for fire extinguishing gas $F_1$ that is assembled as described. That is, the neb part 45*a* of the needle tube 45 is placed above the sealing plate 13 to be apart from the sealing plate 13, the seal breaking member holder 21 is apart from the cylinder holder 15, and the conducting hole 32 and the jetting hole 25 of the housing 19 communicate to the jetting port 3.

When a fire occurs in installing the jetting apparatus for fire extinguishing gas $F_1$ as described, the fire alarm 54 automatically detects the fire or a sufferer operate so that the fire alarm 54 works to sounds an alarm. When the alarm is inputted in the alarm apparatus 53, the alarm is detected by the receiver or the microphone (not shown) that are in the alarm apparatus 53, a signal inputted in the alarm apparatus 53 is amplified, and noise that is not the alarm is taken off. Further, when the alarm apparatus 53 recognizes that the alarm comes from the fire alarm 54, the transmitter sounds an alarm signal that is different from the alarm in tone.

Thus, the alarm signal informs sufferers where the jetting apparatus for fire extinguishing gas $F_1$ is, and helps to use the jetting apparatus for fire extinguishing gas $F_1$ quickly, and a fire can be extinguished early.

When a sufferer finds the jetting apparatus for fire extinguishing gas, the sufferer holds the jetting apparatus for fire extinguishing gas $F_1$, pulls the grip part 55*a* of the safety ring 55 to the side so that the safety ring 55 is removed from the periphery of the bottom case 12, and the bottom case 12 can be pushed in the top case 1.

Then, the sufferer holds the jetting apparatus for fire extinguishing gas $F_1$ and pushes up the bottom case 12, or the sufferer puts the jetting apparatus for fire extinguishing gas $F_1$ on the floor and pushes down the head of the top case 1 against resilience of the spring 42.

Thus, the top case 1 moves toward the bottom case 12 against resilience of the spring 42, or the bottom case 12 is pushed into the top case 1, and the terminal 51 relatively moves with the top case 1. Then, after the terminal 51 passes an interposing position of the insulating film (not shown), the terminal 51 contacts with the terminal 52, which is the other terminal, to electrically conduct to the terminal 52.

Thus, the lamp 48 is energized through the battery 50 to be turned on.

Therefore, a sufferer can easily find the origin of a fire at night, etc., and can surely act to extinguish the fire. After the sufferer extinguishes the fire, the sufferer can use the lamp 48 as guide lamp in escape.

Figure 5:
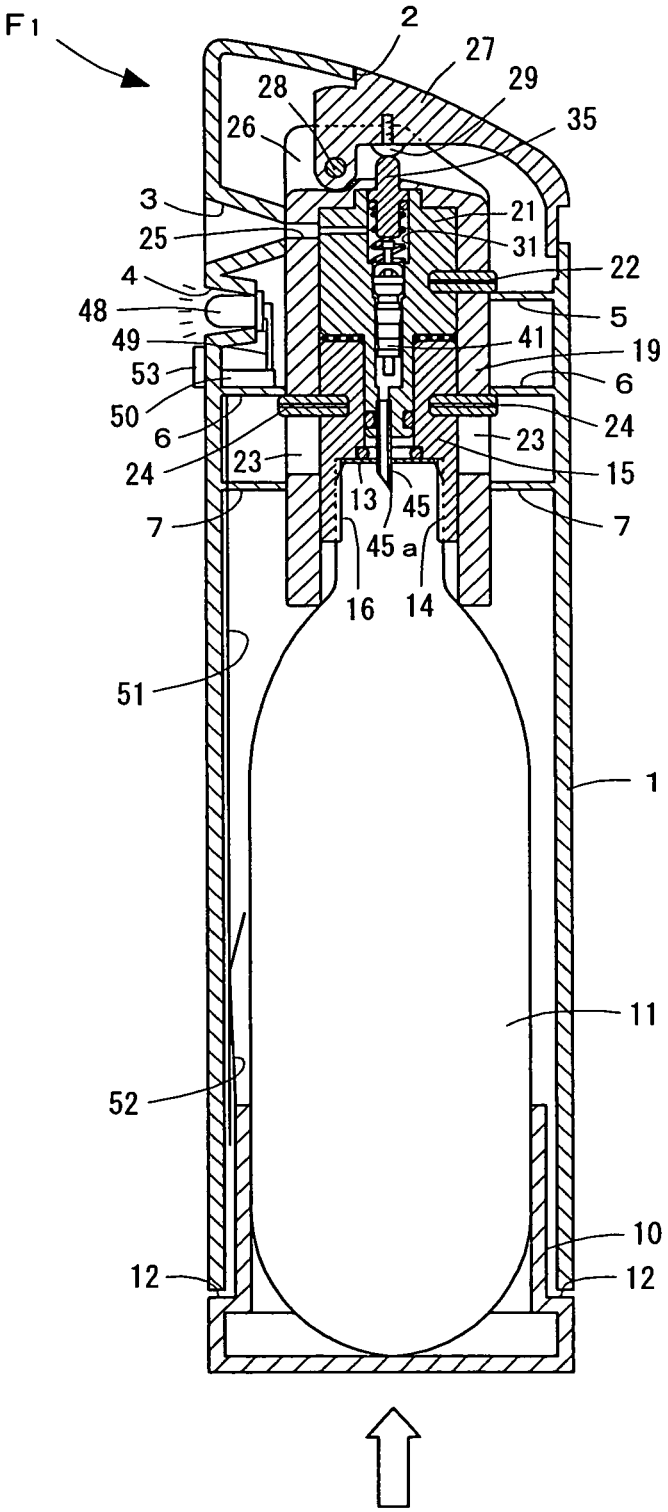
FIG. 5 is a sectional view of this invention in use. A bottom case is pushed to move with a piercing member holder and turn on a lamp, and a piercing pipe pierces the sealing plate to break the sealing plate.
Figure 6:
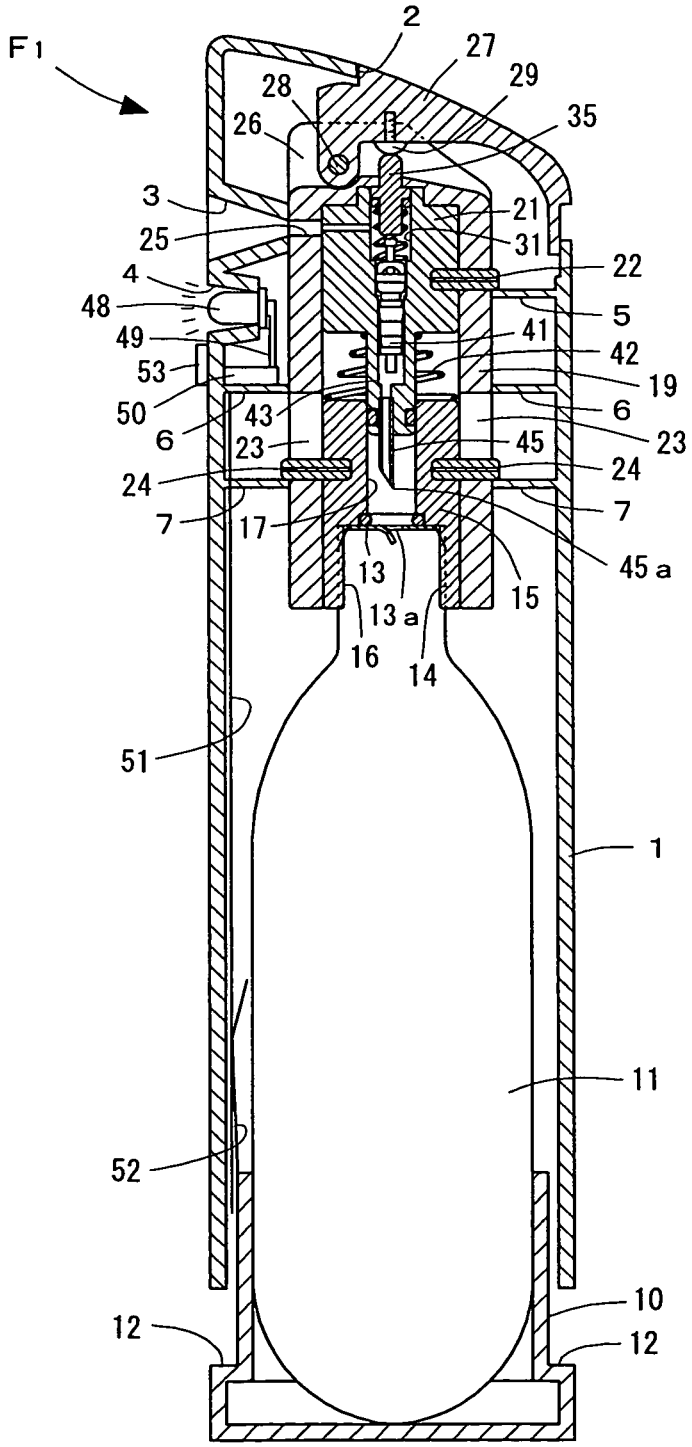
FIG. 6 is a sectional view of this invention in use. Gushed fire extinguishing gas returns the bottom case and the piercing member holder right after the sealing plate is pierced.
Figure 7:
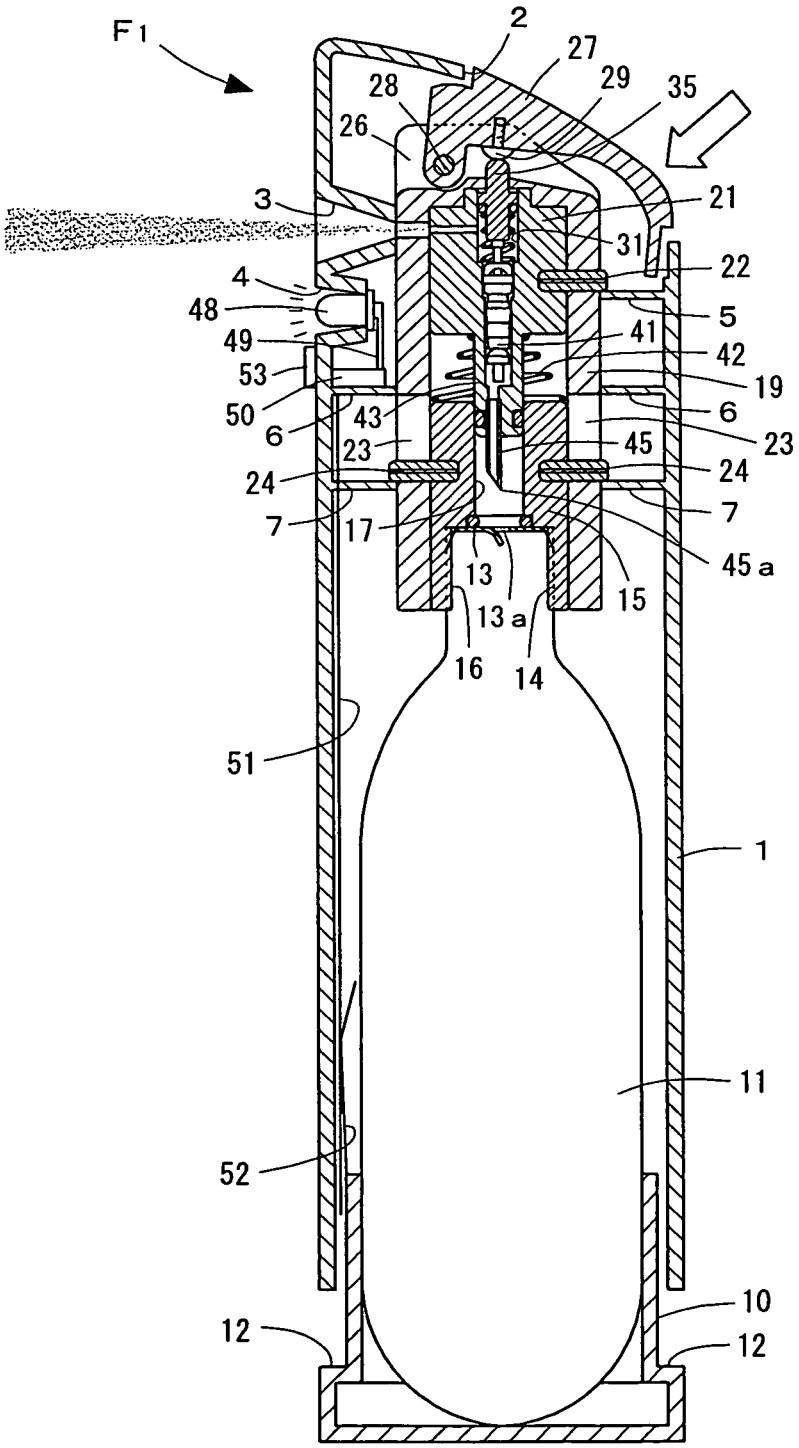
FIG. 7 is a sectional view of this invention in use. A control lever is pushed to open a control valve, and fire extinguishing gas gushes from a jetting hole after the sealing plate is pierced.
Figure 8:
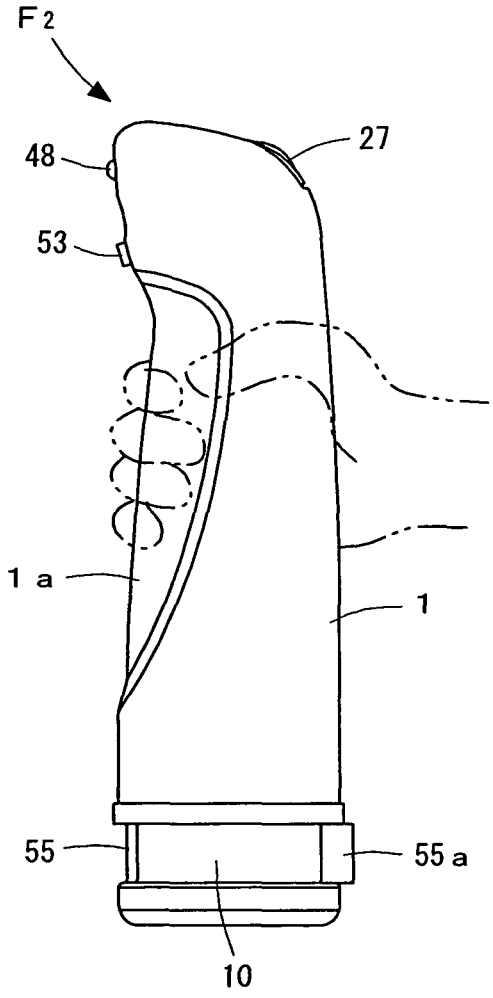
FIG. 8 is a side view of a second embodiment of this invention. A small, light jetting apparatus for fire extinguishing gas is installed before the apparatus is used.
Figure 9:
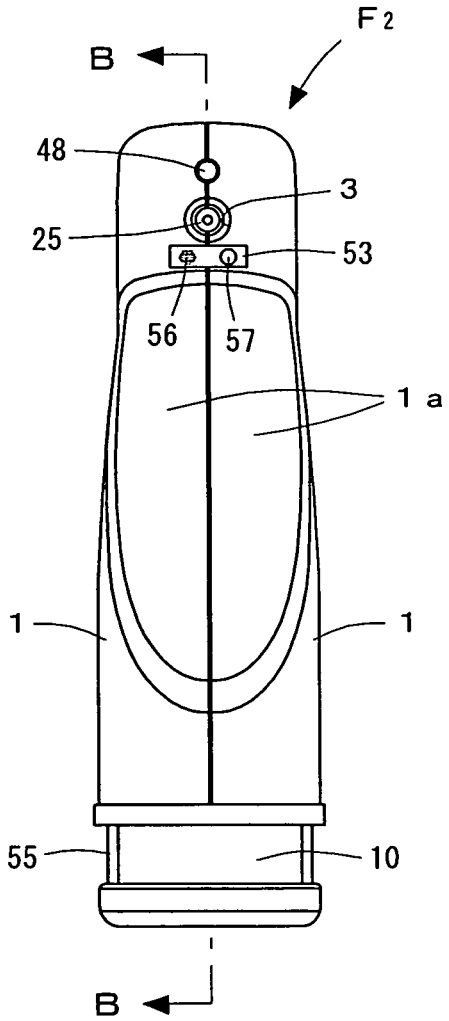
FIG. 9 is a front view of FIG. 8.
Figure 10:
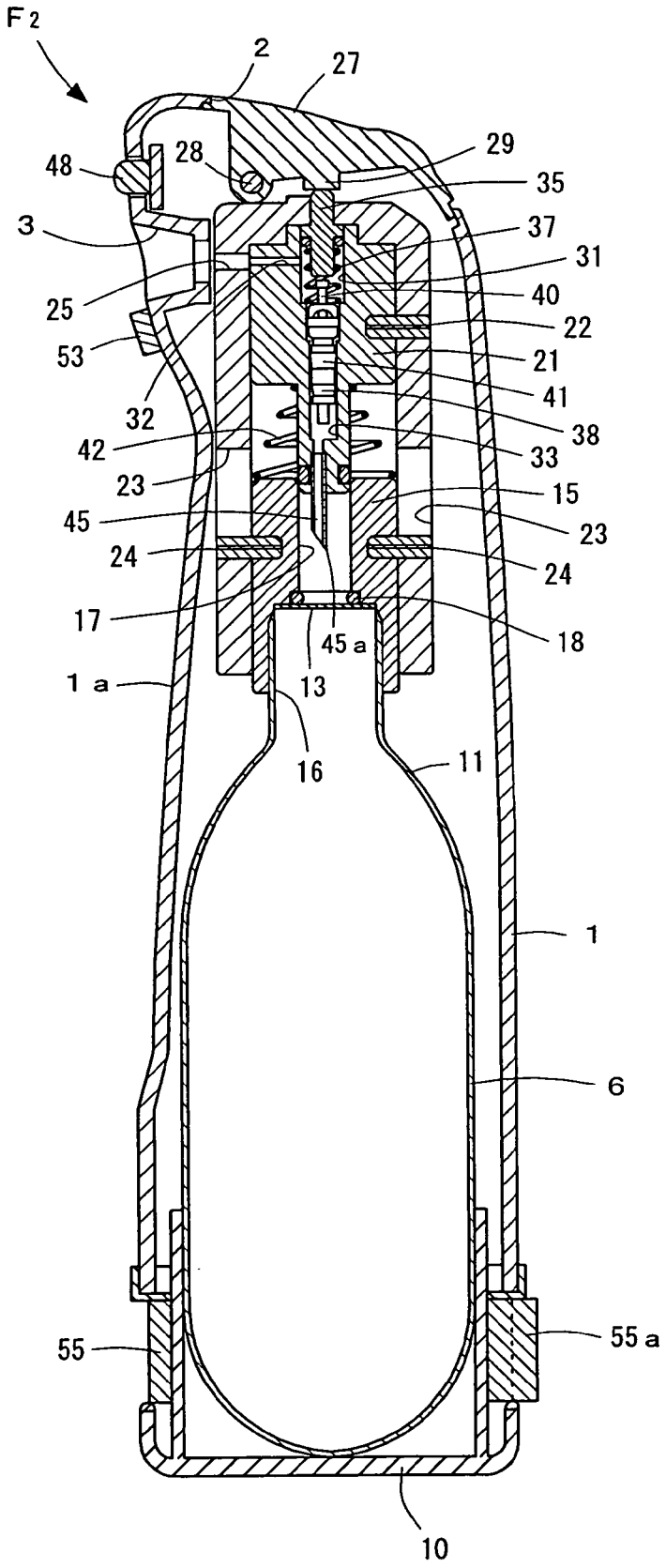
FIG. 10 is an enlarged sectional view taken along the line B-B of FIG. 9.
Figure 11:
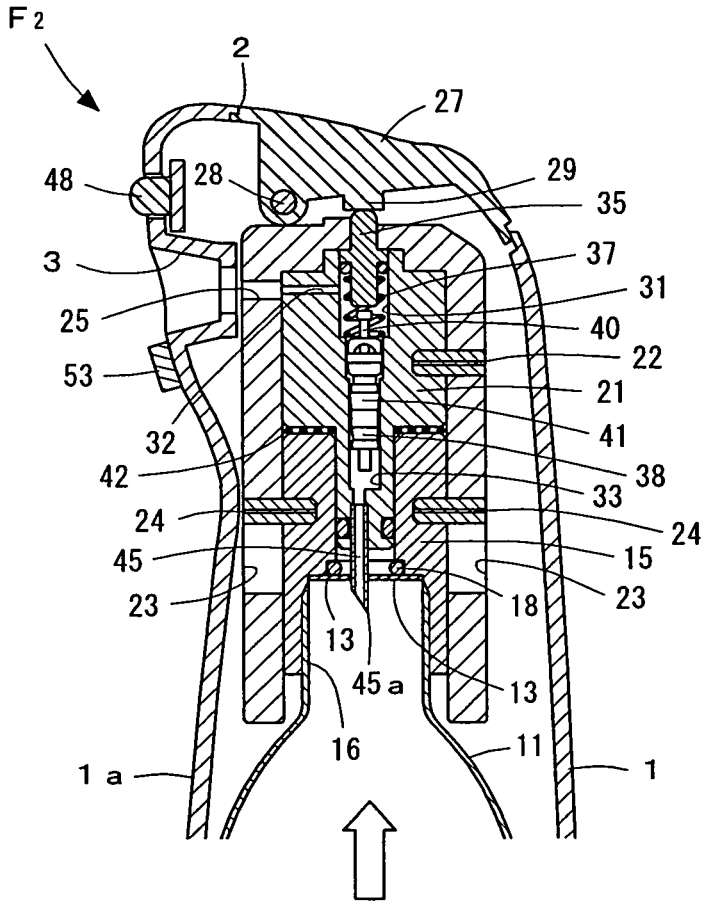
FIG. 11 is a sectional view showing an important part of the jetting apparatus for fire extinguishing gas.
Figure 12:
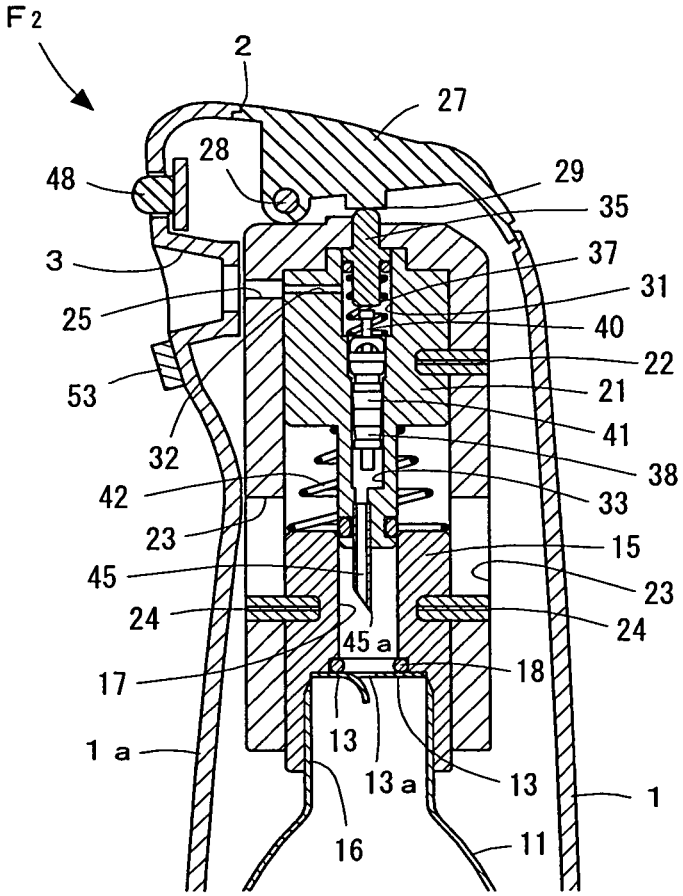
FIG. 12 shows a state that gushed fire extinguishing gas returns a bottom case and a piercing member holder right after the sealing plate is pierced in FIG. 11.
Figure 13:
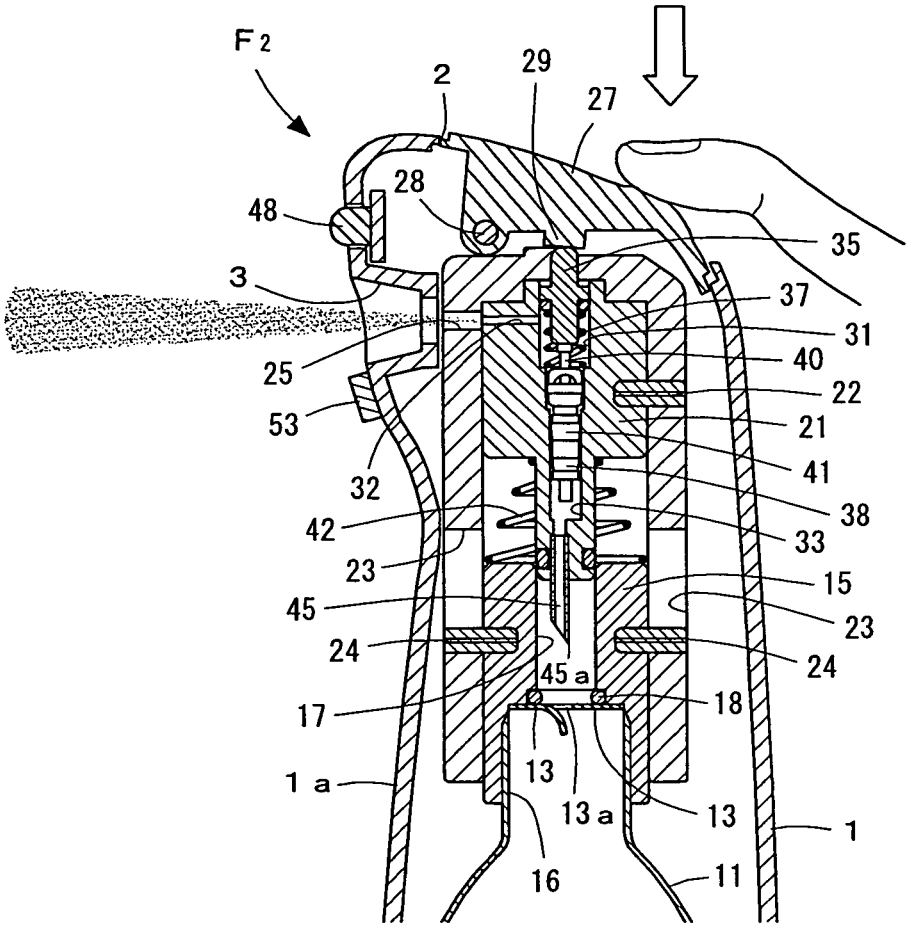
FIG. 13 is a sectional view.
Figure 14:
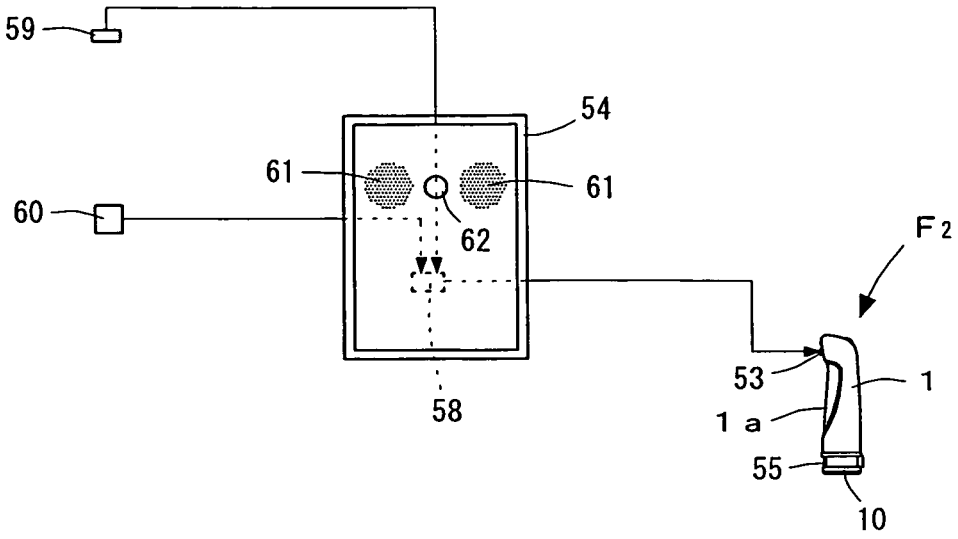
FIG. 14 is an explanatory view.

Next, the lamp 48 is turned on until the voltage of the battery 50 is consumed to be less than a predetermined voltage. This state is shown in FIG. 5.

Further, when the bottom case 12 is pushed up, or the head of the top case 1 is pushed down as descried, the gas cylinder 11 relatively moves upward, the cylinder holder 15 moves with the gas cylinder 11 and pushes the spring 42 to contract the spring 42, and the fastening pins 24 that projects from the cylinder holder 15 moves upward along the long holes 23.

Then, the mouth of the gas cylinder 11 approaches the neb part 45*a* of the seal breaking member 45, and the sealing plate 13 is pierced by the neb part 45*a* to be broken.

In this case, the sealing plate 13 can be broken rationally and easily because the neb part 45*a* pierces the thin, center part of the sealing plate 13.

Further, the cylinder holder 15 moves upward in the housing 19 to move for the vertical length of the long holes 23, the fastening pins 24 engage with an upper end part of the long holes 23, respectively, and then the cylinder holder 15 stops moving upward and the needle tube 45 stops piercing. This state is shown in FIG. 5.

In this case, as the seal breaking member holder 21 is fixed in the housing 19, the jetting port 3, the jetting hole 25 and the conducting hole 32 maintain communicating.

Thus, when the sealing plate 13 is broken, fire extinguishing gas of the gas cylinder 11 moves through the needle tube 45 to gush, and moves to the valve attachment hole 33 that is in the guide shaft 43.

As the valve attachment hole 33 is airtightly sealed by the control valve 38 and the inner valve 41 maintain closing in this case, the fire extinguishing gas that moved to the valve attachment hole 33 stays instead of flowing toward the penetrating hole 31, and pressure of the fire extinguishing gas works on the control valve 38 and a lower part of the seal breaking holder 21.

Therefore, the cylinder holder 21 is pushed up by the pressure of the fire extinguishing gas, the housing 19 moves with the cylinder holder 21, the seal breaking member holder 21 is apart from the cylinder holder 15, and the needle tube 45 is pulled out of a broken part of the sealing plate 13.

At the same time, the long holes 23 moves along the fastening pins 24 to help the housing 19 to move vertically. When lower end parts of the long holes 23 touches the fastening pins 24, the long holes 23 stop moving.

The state that is described above is shown in FIG. 6. The guide shaft 43 that is a part of the seal breaking member holder 21 moves to an upper part of the through hole 17 to enlarge a space of the through hole 17, a broken hole 13*a* opens at the sealing plate 13 and communicates with the through hole 17, and the through hole 17 stores fire extinguishing gas of the gas cylinder 11.

In this case, the state is the same as the described state. That is, as the control valve 38 airtightly seals the valve attachment hole 33, and the inner valve 41 maintains closing, the fire extinguishing gas that moved to the valve attachment hole 33 stays instead of flowing toward the penetrating hole 31.

Thus, as the fire extinguishing gas, which gushed after the sealing plate is broken, once stays in the through hole 17, to be prevented from flowing in this invention, this invention prevents trouble that occurs in conventional fire extinguishers. The trouble is that fire extinguishing gas is wasted because the fire extinguishing gas gushes outside without control and as soon as a seal is broken.

Further, a space that the fire extinguishing gas stays is a little larger than the space that is made in seal breaking according to FIG. 5, however, the capacity of the space that the fire extinguishing gas stays is much smaller than the capacity of the gas cylinder 11. Therefore, the gushed gas is not depressurized to keep liquefying.

On the other hand, the control lever 27 that is attached on the housing 19 moves with moving up of the housing 19, and the top case 1 that engages with the base of the control lever 27 moves with the housing 19 to be apart from the bottom case 10.

Thus, the terminal 52 approaches the terminal 51, however, the battery 50 energizes the lamp 48 to keep the lamp 48 being turned on because the terminals 51 and 52 continue to conduct each other.

At the same time, the housing 19 moves upward with the seal breaking member holder 21 to move for the vertical length of the long holes 23, the top case 1 moves with the housing 19 through the control lever 27, and the jetting hole 25, the jetting port 3 and the conducting hole 32 keep communicating.

Under the described state, a sufferer holds the jetting apparatus for fire extinguishing gas $F_1$ with one hand while directs the jetting port 3 to the origin of a fire; and pushes down an end part of the control lever 27 against resilience of the spring 37.

Then, the control lever 27 turns around the pin 28 to move downward, the engaging projection 29 that is attached on a lower surface of the control lever 27 pushes down an upper end part of the pushrod 35 upward, a lower end part of the pushrod 35 engages with an upper end part of the valve rod 40, and the valve rod 40 is pushed down against resilience of the spring 37.

Therefore, the inner valve 41 moves with the valve rod 40, is apart from a lower end part of the valve body and is pushed to open.

As a result, the inside of the control valve 38 opens to communicate a lower part of the valve attachment hole 33 with the penetrating hole 31 by the control valve 38.

Further, the fire extinguishing gas moves in the control valve 38 to be conducted from the penetrating hole 31 to conducting hole 32, and moves from the jetting hole 25 to the jetting port 3 to jet to the origin of a fire.

In this case, a part of jetted carbon dioxide is insulated and expanded to be dry iced, and then is mixed with gaseous carbon dioxide to jet to the origin of a fire.

Therefore, as the temperature decreases around the origin of a fire and oxygen is prevented from being supplied around the origin of a fire, the fire is extinguished efficiently and quickly.

Thus, the fire extinguishing gas that gushed after seal breaking stays once, and the jetting hole 25 precisely directs to the origin of a fire to jet the fire extinguishing gas, consequently, the fire extinguishing gas jets to the origin of a fire precisely and efficiently without being wasted, and the fire can be extinguished rationally and quickly.

Further, when the sufferer stops pushing the control lever 27 in the fire extinguishing gas jetting, the control lever 27 is pushed by resilience of the spring 37 to return upward, and the pushrod 35 stops pushing the valve rod 40.

Therefore, the valve rod 40 is pushed upward by resilience of the spring that is included in the control valve 38 to return, the inner valve 41 moves with the valve rod 40, and the inner valve 41 tightly contacts with a lower end part of the valve body to close.

Consequently, the inside of the control valve 38 is closed, a lower part of the valve attachment hole 33 and the penetrating hole 31 is prevented from communication, gas that gushes from the jetting hole 25 stops gushing, the fire extinguishing gas that gushed from the broken part stays in the through hole 17, the valve attachment hole 33 that is in the guide shaft 43, and needle tube 45.

The staying gas gushes from the jetting hole 25 if the control lever 27 starts being pushed, the fire extinguishing gas can be effectively used without being wasted.

In addition, after the fire extinguishing gas is completely used, the bottom case 10 is pulled out of the top case 1, a lower part of the shown gas cylinder 11 is held to turn, the threaded part 14 that is at the mouth of the gas cylinder 11 is remove from the screw hole 16 of the cylinder holder 15, and then the empty gas cylinder 11 can be collected.

Next, a new gas cylinder 11 is prepared, a threaded part 14 that is at a mouth of the gas cylinder 11 is screwed into the screw hole 16 to be charged, and the bottom case 10 is inserted in a lower end part of the top case 1, consequently, the new gas cylinder can be used.

Thus, the jetting apparatus for fire extinguishing gas according to this invention realizes that the jetting apparatus for fire extinguishing gas strives to be used repeatedly and effectively.

Further, there is an applied embodiment in this invention. According to the applied embodiment, a powder container filled with fire extinguishing powder is disposed between the jetting hole 25 and the conducting hole 32 or in a proper part, fire extinguishing gas that gushed from the gas cylinder 11 is conducted to the powder container, and the fire extinguishing powder filled in the powder container can gush from the jetting hole 25.

In addition, when pure water or a fire extinguishing liquid chemical is stored in the container and jets by the fire extinguishing gas while the pure water or the fire extinguishing liquid chemical is atomized or foamed, this invention can be used in a fire caused by a chemical, a liquid chemical and electricity.

The other embodiment of this invention is shown in FIGS. 8 to 20, and the same reference numerals are used in parts that correspond with the parts of the described embodiment.

Among FIGS. 8 to 20, FIGS. 8 to 14 show the second embodiment of this invention. The second embodiment is applied to another jetting apparatus for fire extinguishing gas $F_2$ that is small, light and can be carried with one hand.

Regarding the jetting apparatus for fire extinguishing gas $F_2$ in the embodiment, recesses 1*a* and 1*a* are formed at a middle upper part on the front of top cases 1 and 1, so that a sufferer can easily hold the jetting apparatus for fire extinguishing gas $F_2$ with one hand; a lamp 48 is provided over a jetting port 3 that is at an upper part of the top cases 1 and 1, so that the lamp 48 improves in lighting effect.

In order to turning on the lamp 48, a circuit of the power supply is closed through upward displacement of the cylinder holder 15 caused by pushing in the bottom case 10 instead of displacement caused by pushing in the bottom case 10. Therefore, the embodiment strives to simplify wiring and turn on the lamp 48 surely.

An alarm apparatus 53 is provided under the jetting port 3. The alarm apparatus 53 has a speaker 56, an alarm lamp 57, such as an LED, and a receiver (not shown) that can receive a signal of a transmitter 58 provided in an accident alarm 54, and the speaker 56 and/or the alarm lamp 57 can work through reception by the receiver.

The transmitter 58 can work an alarm, a voice guide, an electric wave or an electric signal, and can blink an alarm lamp on and off. The transmitter 58 can input in the transmitter 58 a signal of a fire detector 59, such as a heat sensor or a smoke detector, that can detect a fire occurring, and a signal of a vibration detector 60 that can detect vibration being a predetermined Japanese seismic scale therein.

When the signals of the detectors are inputted in the transmitter 58, the transmitter 58 works. The transmitter 58 works to run a speaker 61, a voice guide recorder, an oscillator or an alarm lamp 62, which are provided in the accident alarm 54. Thus, the transmitter 58 can alarm for an occurrence of a fire or an earthquake by hearing and seeing.

The voice guide announces, for example, "There is a fire. Calm down and escape," "The emergency exit is ahead," "There is an earthquake. Calm down and take refuge," and "There is an earthquake. Make sure the fire is out," to inform of occurrence of an accident and instruct to make sure of an escapeway.

Regarding the jetting apparatus for fire extinguishing gas as described, the fire detector 59 detects a fire to input a signal in the transmitter 58, the speaker 61 sounds an alarm and a voice guide. The alarm and the voice guide announce, "There is a fire. Calm down and escape," and "The emergency exit is ahead," etc. and the alarm lamp 57 blinks on and off to inform of occurrence of a fire.

On the other hand, the signal for a fire is inputted from the transmitter 58 into the alarm apparatus 53, which is attached on the jetting apparatus for fire extinguishing gas, and then an alarm sounds from a speaker 56 of the alarm apparatus 53 and a alarm lamp 57 blinks on and off to inform presence of the jetting apparatus for fire extinguishing gas.

Therefore, a user can find the jetting apparatus for fire extinguishing gas $F_2$ easily and quickly, and can operate the jetting apparatus for fire extinguishing gas $F_2$ as described so that the user can accurately and effectively jet carbon dioxide from the jetting hole 25 to the origin of a fire to extinguish the fire.

Further, in case an earthquake that is a predetermined Japanese seismic scale is occurs, the vibration detector 60 detects an earthquake occurring to input a signal in the transmitter 58, the speaker 61 sounds an alarm and a voice guide. The alarm and the voice guide announce, "There is an earthquake. Calm down and take refuge," and "There is an earthquake. Make sure the fire is out," etc. and the alarm lamp 62 blinks on and off to inform of occurrence of an earthquake.

Next, an alarm signal for an earthquake is inputted from the transmitter 58 into the alarm apparatus 53, which is attached on the jetting apparatus for fire extinguishing gas $F_2$, and then an alarm sounds from the speaker 56 of the alarm apparatus 53 and the alarm lamp 57 blinks on and off to inform presence of the jetting apparatus for fire extinguishing gas. Thus, a user can quickly deal with a fire when a fire occurs after an earthquake.

As the speaker 61 sounds and the alarm lamp 57 blinks on and off after fire fighting or an earthquake, a user moves while holding the used jetting apparatus for fire extinguishing gas $F_2$ to escape safely. Further, as the user informs of his/her existence, the user can be found easily, and then can be rescued and helped quickly and easily.

In addition, each of the jetting apparatuses for fire extinguishing gas $F_1$ and $F_2$ attaches an alarm apparatus 53 on the periphery thereof in the embodiment, each of the jetting apparatuses for fire extinguishing gas $F_1$ and $F_2$ can include the alarm apparatus 53 therein to be installed so that the alarm apparatus 53 can be protected and the jetting apparatuses for fire extinguishing gas $F_1$ and $F_2$ can be better in appearance.

Figure 15:
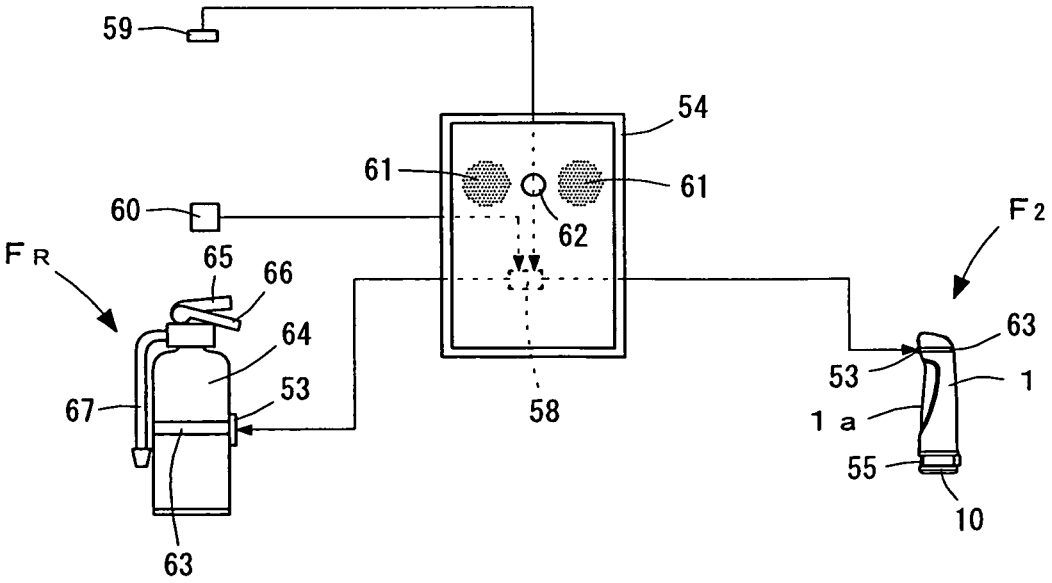
FIG. 15 is an explanatory view of a third embodiment of this invention. The alarm apparatus is detachably attached on a small, light jetting apparatus for fire extinguishing gas and a large, heavy jetting apparatus for fire extinguishing gas, and an alarm signal of a fire or an earthquake from the accident alarm is inputted into the alarm apparatus.
Figure 16:
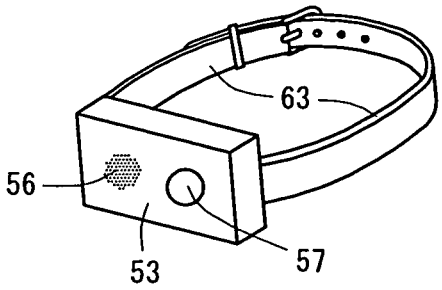
FIG. 16 is a perspective view showing the alarm apparatus that is applied to the third embodiment and can be attached and detached.
Figure 17:
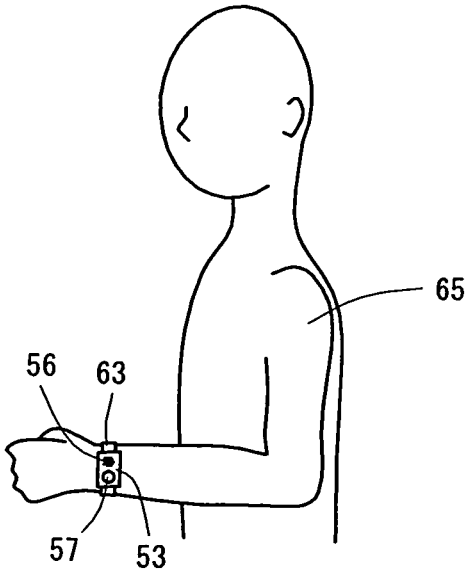
FIG. 17 is an explanatory view. The alarm apparatus in FIG. 16 is detached from the jetting apparatus for fire extinguishing gas and a sufferer wears the alarm apparatus to use the alarm apparatus.

The third embodiment is shown in FIGS. 15 to 17. Regarding the third embodiment, each of the jetting apparatuses for fire extinguishing gas $F_1$ and $F_2$ does not attach an alarm apparatus 53 thereon to unite with the alarm apparatus 53, however, each of the jetting apparatuses for fire extinguishing gas $F_1$ and $F_2$ attaches an alarm apparatus 53 thereon with string or a belt 63 to be detachable.

Thus, the jetting apparatuses for fire extinguishing gas $F_1$ and $F_2$ attempt to be simplified in structure. Further, the alarm apparatus 53 can be easily attached on the jetting apparatuses for fire extinguishing gas $F_1$ and $F_2$, which have already installed, later as supplement; improves in being used and replaced; can be attached on a trunk part of a jetting apparatus for fire extinguishing gas $F_R$ that is conventionally used and is large and heavy; and then can be used well.

Further, after disaster or in refuge, a sufferer removes the alarm apparatus 53 from the jetting apparatus for fire extinguishing gas $F_1$, $F_2$ or $F_R$ and wears the alarm apparatus 53 on the body, such as wrist or arm, and then the sufferer 65 can be found and rescued easily and his/her safety can be known easily.

Reference numeral 65 is a movable lever that is attached on an upper part of the jetting apparatus for fire extinguishing gas $F_R$ to turn upward and downward, reference numeral 66 is an immovable lever, and reference numeral 67 is a hose nozzle in the drawing.

Incidentally, the alarm apparatus 53 may be attached and detached through a pin, a snap, a hook and loop fastener and a button to be detachable.

Figure 18:
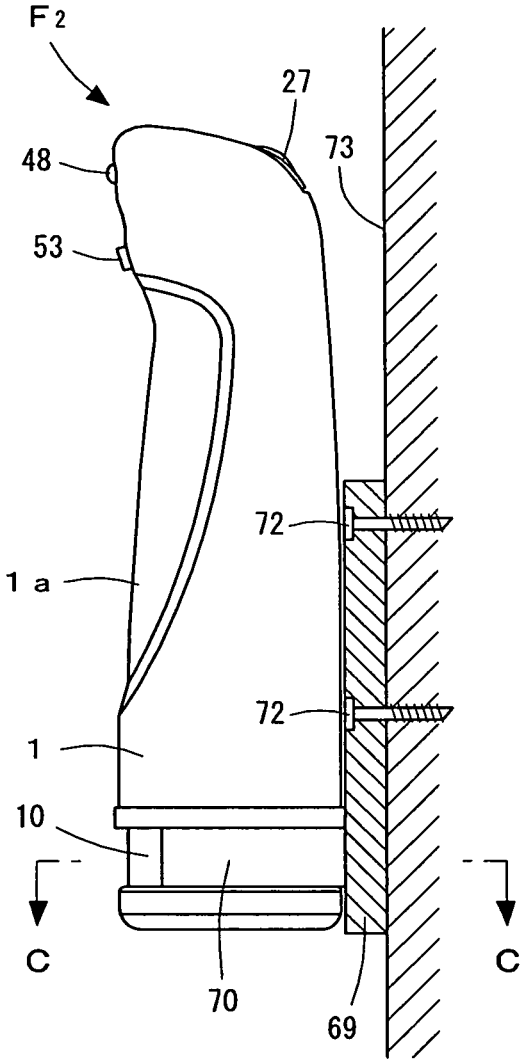
FIG. 18 is a sectional view of a fourth embodiment of this invention. A jetting apparatus for fire extinguishing gas $F_2$ is installed by an installation holder.
Figure 19:
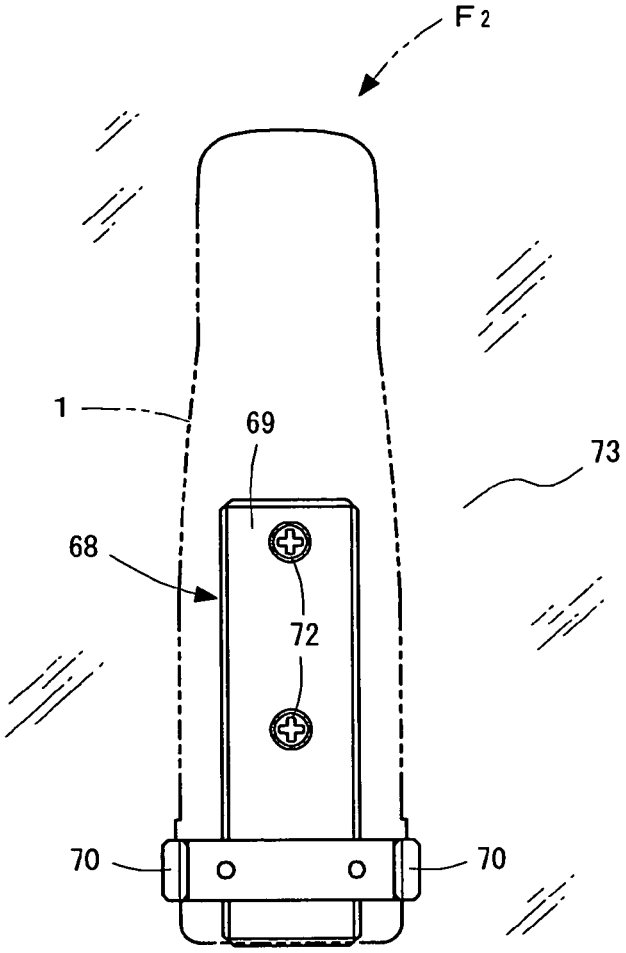
FIG. 19 is a front view. The installation holder that is applied to the fourth embodiment
Figure 20:
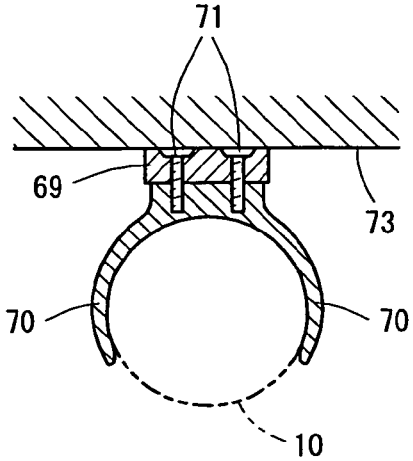
FIG. 20 is a sectional view taken along the line C-C of FIG. 18.

The fourth embodiment is shown in FIGS. 18 to 20. Regarding the fourth embodiment, a installation holder 68 that holds the jetting apparatus for fire extinguishing gas $F_2$ takes the place of the safety ring 55 because the installation holder 68 has ability to work like the safety ring 55. Therefore, the fourth embodiment prevents the gas cylinder 11 from being broken by mistake.

The installation holder 68 has a holder board 69 that is a lengthwise rectangle and made of synthetic resin, and a pair of clutching arms 70, 70. The clutching arms 70 and 70 are attached on a lower end of the holder board 69 by screws 71, and have suitable resilience.

Regarding the installation holder 68, the holder board 69 is attached on a desired position of a wall 73 in a building, inside or outside of a vehicle, etc. through screws 72 or double-faced tape. The bottom case 10 of the jetting apparatus for fire extinguishing gas $F_2$ is put between the clutching arms 70, 70 to be held between the clutching arms 70, 70 by resilience of the clutching arms 70, 70, and the jetting apparatus for fire extinguishing gas $F_2$ is held. Therefore, the bottom case 10 is prevented from moving upward and the gas cylinder 11 is previously prevented from being broken when the jetting apparatus for fire extinguishing gas $F_2$ is not used.

On the other hand, when the jetting apparatus for fire extinguishing gas $F_2$ is used, the jetting apparatus for fire extinguishing gas $F_2$ is pulled forward out of the clutching arms 70, 70 against pressure of the clutching arms 70, 70 so that the bottom case 10 can move upward. The bottom case 10 is pushed upward, and then the gas cylinder 11 can be broken.

Therefore, there is no need to perform complicated operation that the jetting apparatus for fire extinguishing gas $F_2$ is pulled out of the installation holder 68, and then the safety ring is pulled out. As a user perform the operation at once, and the user can quickly use the jetting apparatus for fire extinguishing gas $F_2$ early and extinguish a fire quickly.

Thus, the embodiment attaches the jetting apparatus for fire extinguishing gas $F_2$ on the installation holder 68, and can prevent the gas cylinder 11 from being broken by mistake.

Thus, a jetting apparatus for fire extinguishing gas of the present invention easily breaks a sealing plate of a small gas cylinder charged therein, temporarily prevents gushed fire extinguishing gas from outflowing and being wasted by a valve, and attempts to use the fire extinguishing gas effectively and extinguish a fire effectively. Further, this invention jets the fire extinguishing gas to the origin of a fire surely and properly in fire fighting so that this invention realizes that a fire is extinguished effectively, surely and early; and informs sufferers where a fire extinguisher is when a fire occurs so that a sufferer can use the fire extinguisher quickly and extinguish a fire early. Therefore, the present invention is suitable for a handy fire extinguisher, for example, in a house, an office and a vehicle.

The invention claimed is:

1. A jetting apparatus for fire extinguishing gas comprising:

a gas cylinder charged with pressurized fire extinguishing gas and to which is attached a sealing plate on an opening thereof;

a case provided outside the gas cylinder, the case comprising a top part;

an outer housing provided inside the case top part;

a seal breaking member holder and a cylinder holder provided in the outer housing, the seal breaking member holder being provided at an upper part and the cylinder holder being provided at a lower part, the cylinder holder being movable upwardly and downwardly and normally biased downwardly;

a conducting hole formed in the seal breaking member holder and communicating with the exterior of the jetting apparatus;

a control valve sealingly provided in a valve attachment hole, the control valve being closed to block the flow of fire extinguishing gas through the valve attachment hole when the jetting apparatus is in a ready-for-use state and the control valve being opened to permit the flow of fire extinguishing gas when the jetting apparatus is in use;

a seal breaking member that has a neb configured to break the sealing plate and which is provided at a lower end of the seal breaking member holder;

a guide hole formed in the cylinder holder for housing the seal breaking member in a moveable arrangement and a mouth part of the gas cylinder positioned in a lower end of the guide hole, the mouth part being detachable from the guide hole, wherein the valve attachment hole comprises a passage for the flow of fire extinguishing gas from the gas cylinder, the passage being in communication with the guide hole and the conducting hole;

a case bottom part slidably attached to a lower part of the case top part;

a bottom of the gas cylinder being received in the case bottom part;

a safety ring attached to a step positioned between a lower end of the case top part and the case bottom part, the safety ring configured to be removable from the step;

a fire detector and a vibration detector installed in a preselected indoor location;

an accident alarm which receives a sensor signal from the fire detector and the vibration detector and transmits an electric warning signal;

an alarm apparatus provided on a surface of the case top part for receiving the electric warning signal from the accident alarm, and wherein, the alarm apparatus is provided with an alarm or an alarm lamp that activates upon receiving the electric warning signal; and upon removal of the safety ring, the case top part is movable downward, the case bottom part is movable upward, and whereby upon movement downward of the case top part and movement upward of the case bottom part, the neb engages and breaks the sealing plate.

2. A jetting apparatus for fire extinguishing gas according to claim 1, wherein the control valve can open on demand.

3. A jetting apparatus for fire extinguishing gas according to claim 1, wherein the valve attachment hole is formed in the seal breaking member holder, and the control valve is positioned in the middle of the valve attachment hole.

4. A jetting apparatus for fire extinguishing gas according to claim 1, further comprising a control lever turnably connected on an upper part of the outer housing and is disposed on a surface of the case top part; the seal breaking member holder being fixed in the housing; a pushrod configured to engage with the control valve and the control lever being provided on an upper part of the seal breaking member holder, the pushrod being movable in a vertical direction; whereby, upon actuation of the control lever the pushrod engages the control valve.

5. A jetting apparatus for fire extinguishing gas according to claim 1, wherein after the sealing plate is broken, the cylinder holder moves upwardly, and the seal breaking member is apart from the sealing plate.

6. A jetting apparatus for fire extinguishing gas according to claim 1, wherein the alarm apparatus is provided with a lamp.

7. A jetting apparatus for fire extinguishing gas according to claim 6, wherein a case bottom part is slidably attached to a lower part of the case top part; a bottom of the gas cylinder being received in the case bottom part; and when the case bottom part is operated to move upward, the case bottom part or the cylinder holder moves upward to turn on the lamp.

8. A jetting apparatus for fire extinguishing gas according to claim 6 or 7, wherein the lamp is configured to keep lighting after the sealing plate is broken.

9. A jetting apparatus for fire extinguishing gas according to claim 1 in combination with a wall mountable holder for the jetting apparatus, the holder comprising a pair of clutching arms facing each other and configured retain the jetting apparatus and to provide for removal of the jetting apparatus from the clutching arms.

10. A jetting apparatus for fire extinguishing gas according to claim 1, wherein the alarm apparatus is detachable from the case top part and is configured to be worn by a person when the alarm apparatus is detached from the case top part.

11. A kit comprising two jetting apparatuses for fire extinguishing gas according to claim 1, one being operable with one hand and portable and the other being larger, heavier, operable with both hands and installed in place.

12. A jetting apparatus for fire extinguishing gas according to claim 1, further comprising a container storing a fire extinguishing agent selected from a fire extinguishing powder, a fire extinguishing liquid chemical, a fire extinguishing chemical or fire extinguishing water; the container positioned to receive the fire extinguishing gas; and the fire extinguishing agent being jetted from a jetting port provided on the jetting apparatus upon actuation of the jetting apparatus, the jetting port being in communication with the conducting hole.

13. A jetting apparatus for fire extinguishing gas according to claim 1, wherein the alarm apparatus is attached to the jetting apparatus with a string or belt, the alarm apparatus being detachable from the jetting apparatus.

14. A jetting apparatus for fire extinguishing gas according to claim 1, wherein the valve attachment hole and the control valve are disposed in the middle of the passage.

15. A jetting apparatus for fire extinguishing gas according to claim 14, wherein the seal breaking member has a tubular shape, the seal breaking member being disposed at a lower end of the passage, the seal breaking member holder storing fire extinguishing gas which gushes from the gas cylinder after the sealing plate is broken by a breaking movement of the seal breaking member against the sealing plate.

* * * * *